US011116287B2

(12) United States Patent
Pelkofer

(10) Patent No.: US 11,116,287 B2
(45) Date of Patent: Sep. 14, 2021

(54) TENSION MAINTAINING SYSTEM FOR FOOTWEAR LACES

(71) Applicant: Brad Jeffrey Pelkofer, Cranberry Township, PA (US)

(72) Inventor: Brad Jeffrey Pelkofer, Cranberry Township, PA (US)

( * ) Notice: Subject to any disclaimer, the term of this patent is extended or adjusted under 35 U.S.C. 154(b) by 0 days.

(21) Appl. No.: 16/408,033

(22) Filed: May 9, 2019

(65) Prior Publication Data

US 2019/0343234 A1 Nov. 14, 2019

Related U.S. Application Data

(60) Provisional application No. 62/668,983, filed on May 9, 2018.

(51) Int. Cl.
*A43C 7/04* (2006.01)
*A43B 5/16* (2006.01)

(52) U.S. Cl.
CPC . *A43C 7/04* (2013.01); *A43B 5/16* (2013.01)

(58) Field of Classification Search
CPC ..... A43C 7/04; A43C 7/005; A43B 5/16
See application file for complete search history.

(56) References Cited

U.S. PATENT DOCUMENTS

| | | | | |
|---|---|---|---|---|
| 6,029,323 | A * | 2/2000 | Dickie | A43C 1/003 24/712.1 |
| 9,468,262 | B2 * | 10/2016 | Caron | A43C 7/005 |
| 9,743,713 | B1 * | 8/2017 | Lam | A43C 7/04 |
| 2009/0236870 | A1 * | 9/2009 | Duncan | B60J 7/141 296/136.04 |
| 2013/0160256 | A1 * | 6/2013 | Waldman | A43C 7/04 24/712.6 |
| 2014/0020263 | A1 * | 1/2014 | Theuvenet | A43B 3/001 36/50.1 |

* cited by examiner

*Primary Examiner* — Ted Kavanaugh
(74) *Attorney, Agent, or Firm* — Indiana University Maurer School of Law Intellectual Property Legal Clinic

(57) ABSTRACT

A clamp includes a cap, a base, a plurality of staggered protrusions on the base and the cap, a hinge, and a latch. The hinge is defined by the cap and the base. The latch is configured to secure the cap to the base. A footwear includes laces on the foot wear and at least one aforementioned clamp, which clamps at least two of the laces.

9 Claims, 33 Drawing Sheets

TENSION MAINTAINING SYSTEM FOR FOOTWEAR LACES

RELATED APPLICATION

This application claim priority to a provisional application, U.S. Provisional Application No. 62/668,983, filed May 9, 2018, naming Bradley J. Pelkofer et al., and titled "Tension Maintaining System for Footwear Laces," which is hereby incorporated by reference.

BACKGROUND

Footwear laces are widely use, but keeping them tight can be challenging. Athletes and other active people before each activity tie their laces to maintain stability and/or safety. One problem is that as these activities continue, laces can become looser.

SUMMARY

One aspect of this disclosure relates to a clamp attached to laces. Once users have tightened laces to a certain level of tension or comfort the clamp is attached to the laces to reduce or eliminate loosening of the tension. In some embodiments, the clamp is attached to certain types of athletic laces, such as those provided on hockey skates. In another embodiment, the clamp is attached to other types of laces, such as basketball shoelaces, football cleat laces, soccer cleat laces, other forms of ice skate laces, and other recreational footwear laces.

According to one aspect of this disclosure a footwear is provided that comprises a sole and an upper supported by the sole. The upper has a plurality of attachments including first and second attachments. The footwear further comprises at least one lace coupled to the upper. The at least one lace has a plurality of lace portions including a first upper-most attachment lace portion extending down from the first attachment and a second upper-most attachment lace portion extending down from the second attachments. The footwear further comprises a clamp positioned below the first and second attachments and coupling two of the plurality of lace portions together.

According to another aspect of the present disclosure, a method of securing two portions of a lace of a footwear is provided. The method comprises the steps of providing a footwear having a sole, an upper supported by the sole, and at least one lace coupled to the upper, and a plurality of clamps. The method further includes the steps of tightening the at least one lace to tighten the upper around a user's lower leg, and clamping at least two of the clamps to the at least one lace after the tightening step.

Additional features of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The detailed description of the drawings particularly refers to the accompanying Figures in which.

Figure 1:
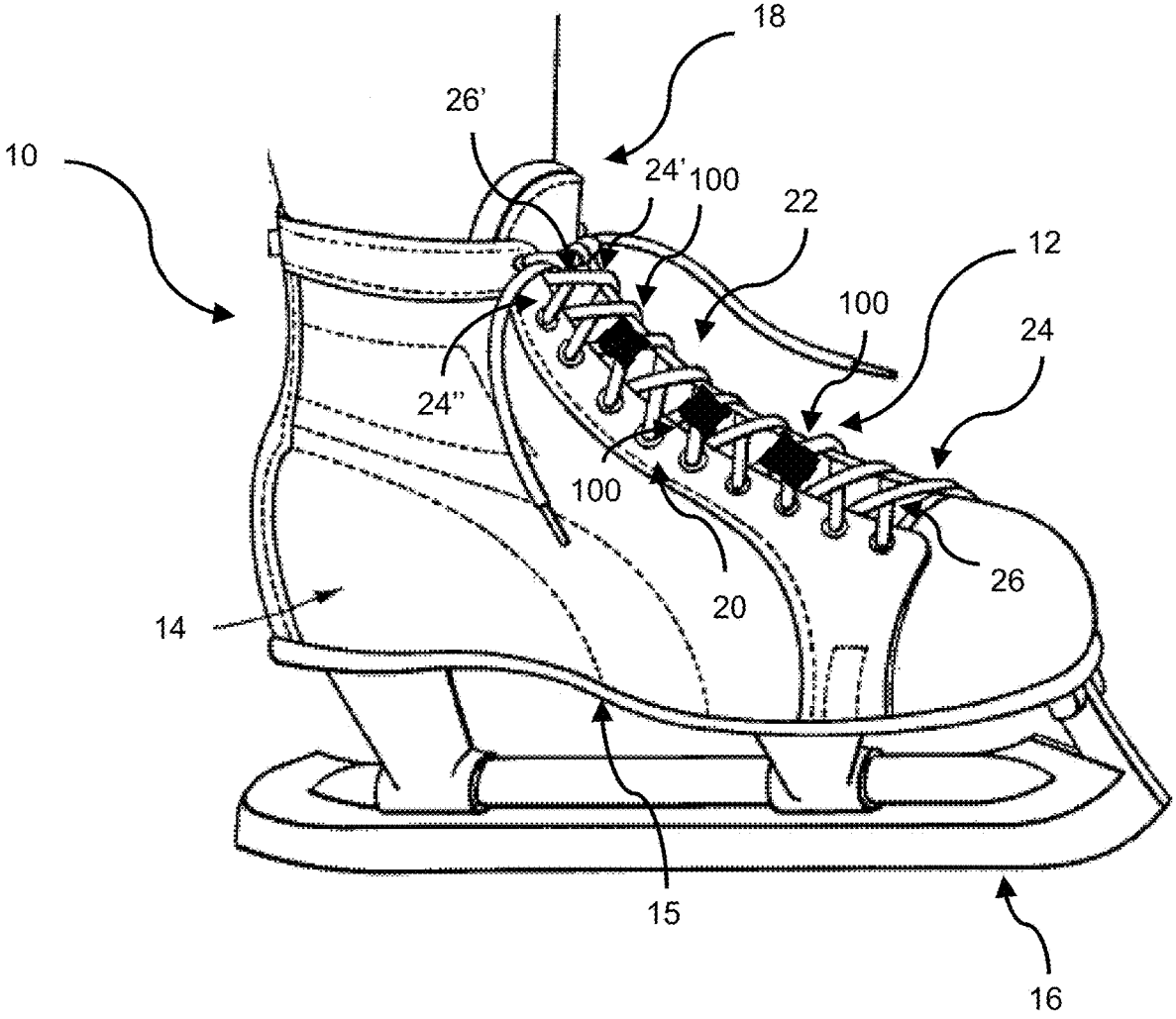
FIG. 1 is perspective view of a skate having laces forming an X-shape or crisscross pattern when the laces are tightened and three clamps positioned to clamp the crisscrossed portions of the lace together.

For the purposes of promoting an understanding of the principals of the disclosure, reference will now be made to the embodiments illustrated in the drawings, which are described below. The embodiments disclosed in the following detailed description are not intended to be exhaustive or limit the disclosure to the precise form disclosed in the following detailed description. Rather, the embodiments are chosen and described so that others skilled in the art may utilize their teachings. Unless otherwise indicated or apparent, the components shown in the figures are proportional to each other. It will be understood that no limitation of the scope of the disclosure is thereby intended. The disclosure includes any alterations and further modifications in the illustrative devices and described methods and further applications of the principles of the disclosure which would normally occur to one skilled in the art to which the disclosure relates.

DETAILED DESCRIPTION

Referring to FIG. 1, an ice skate, one type of footwear, 10 is shown. Skate 10 includes an upper portion or upper 12 including a heal 14, a sole 15, a blade 16 attached to sole 15, a tongue 18, eyelets or attachments 20 provided on upper 12, and laces 22. Laces 22 are used to tighten upper 12 and are arranged in a pattern through attachments 20. In one embodiment, laces 22 are tied in an X-shape or crisscross pattern as shown in FIG. 1. Attachments 20 may be provided in forms other than eyelets. For example, attachments 20 may be loops attached to upper 12.

Figure 2:
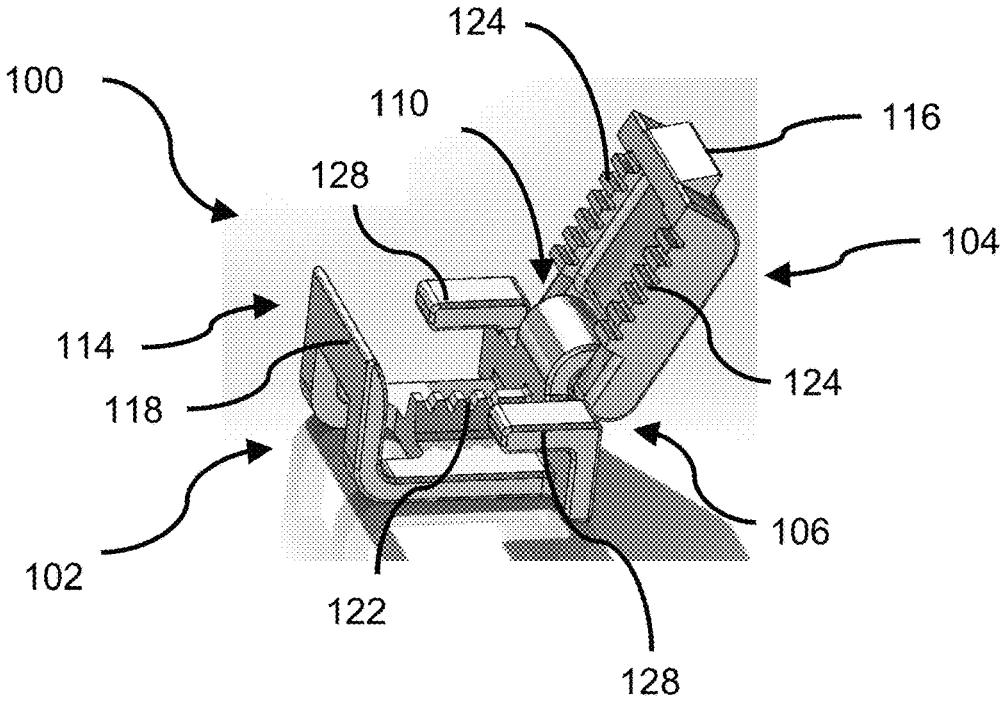
FIG. 2 is a perspective view of a clamp of FIG. 1 showing the clamp including a base and a cap coupled to the base in an open configuration.

Referring to FIG. 2, an exemplary embodiment of a lace-retention unit 100 is shown in the form of a retention clamp. When retention clamp 100 is applied to crisscrossing laces 22 of skate 10 (FIG. 1) and clamped, laces 22 are clamped together to reduce or eliminate movement between laces 22 to assist in maintaining the initial tightness of laces 22.

Laces 22 includes a plurality of lace portions 24 that extend from attachments 20. Pairs of lace portions 24 often cross to form an X-shape 26. Retention clamp 100 clamps one or more of these pairs of lace portions 24 together. Often, a pair of attachments 20 are positioned adjacent one another on opposite sides of tongue 18. An upper-most X-shape 26' is defined by a pair of lace portions 24 that includes a first upper-most lace portion 24' that extends down from a first upper-most attachment 20 (e.g. on the left side of tongue 18) and a second upper-most lace portion 24" that extends down from a second upper-most attachment 20 (e.g. on the right side of tongue 18). As shown in FIG. 1, clamps 100 are positioned below first and second upper-most attachments 20. As shown in FIG. 1, attachments 20 are provided in pairs that are at the same height on footwear 10. In other embodiments, attachments 20 may be staggered so that a first upper-most attachment 20 on the left side is higher (or lower) than a second upper-most attachment on the right side.

Figure 3:
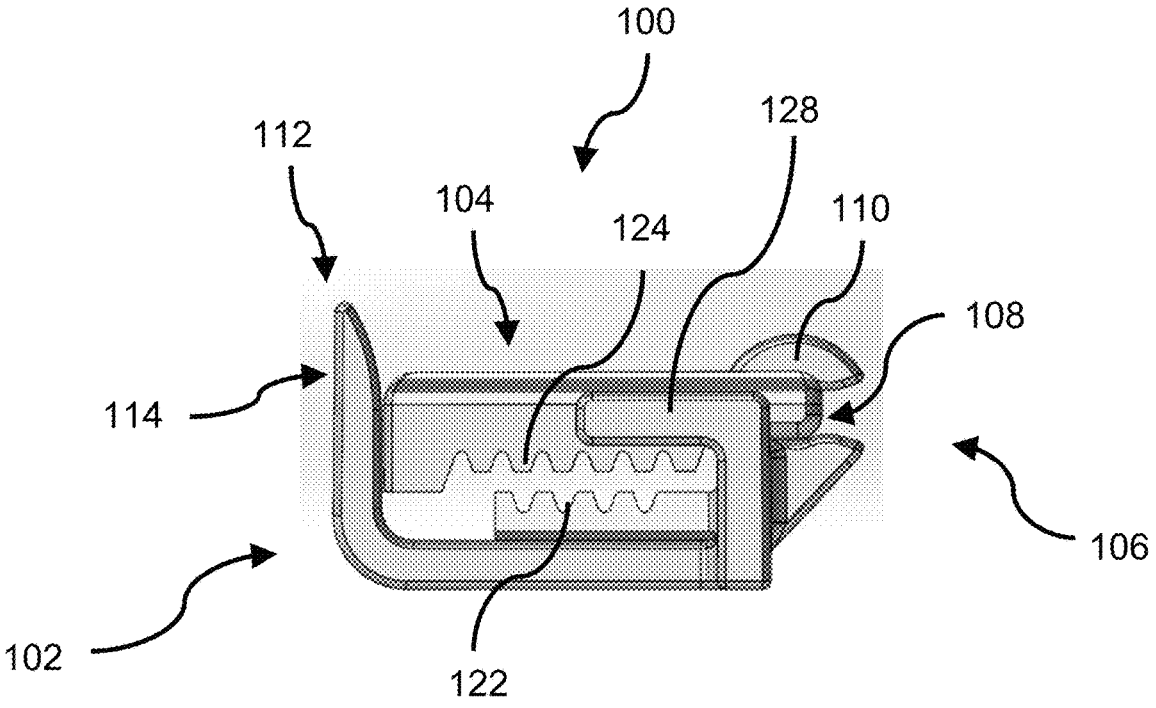
FIG. 3 is a side view of the clamp of FIG. 2 showing the cap in a closed configuration.
Figure 4:
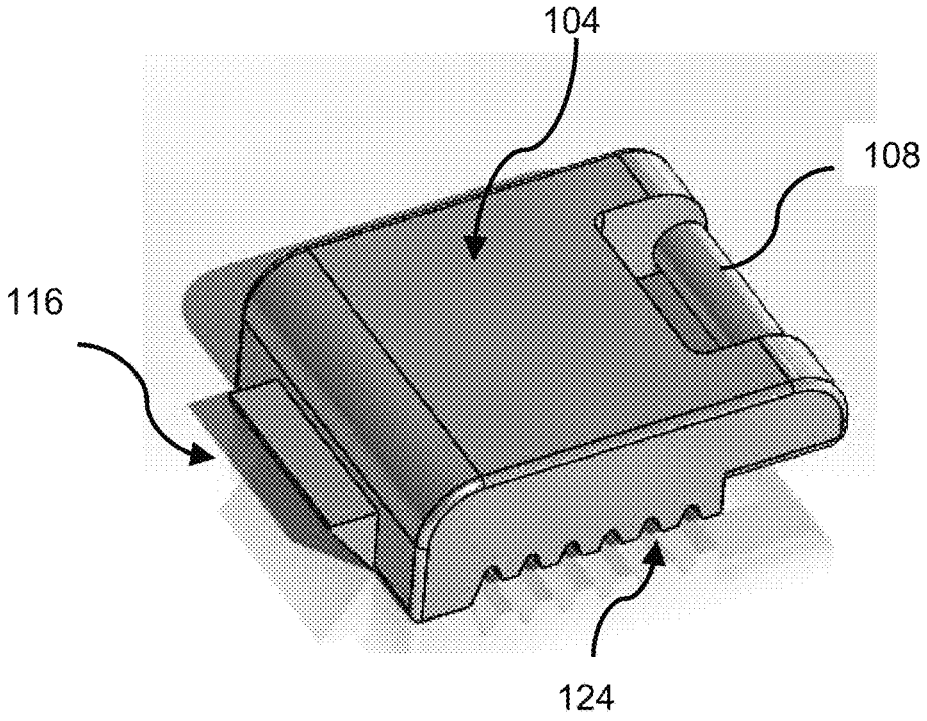
FIG. 4 is a perspective view of the cap without the base.
Figure 5:
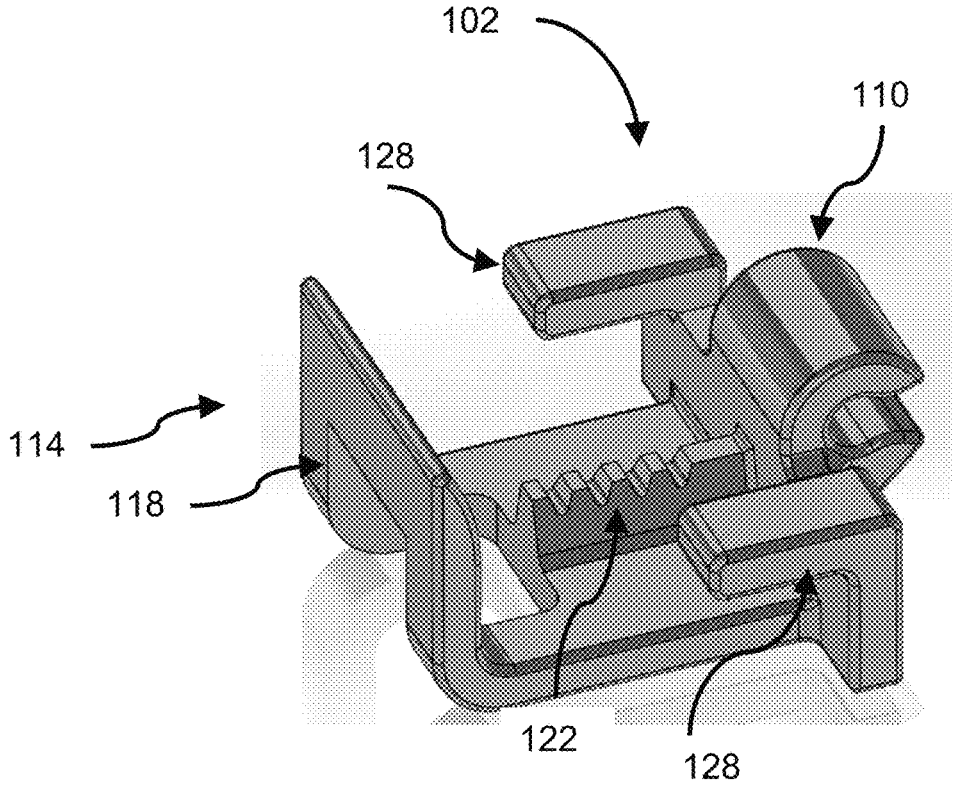
FIG. 5 is a perspective view of the base without the cap.
Figure 6:
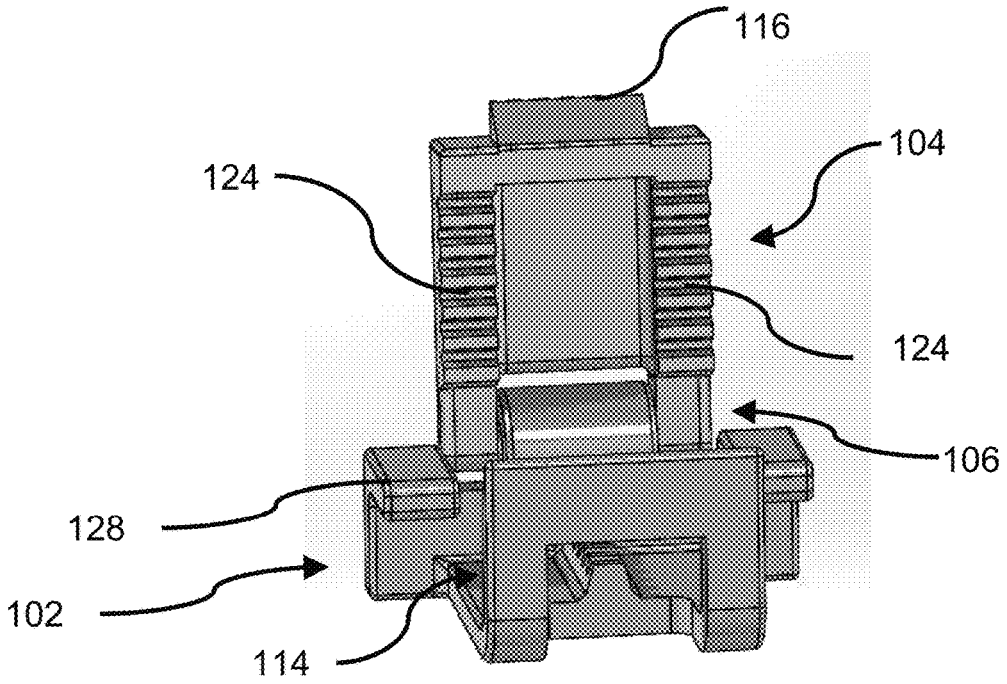
FIG. 6 is another perspective view of the clamp of FIG. 2 in the open configuration.
Figure 7:
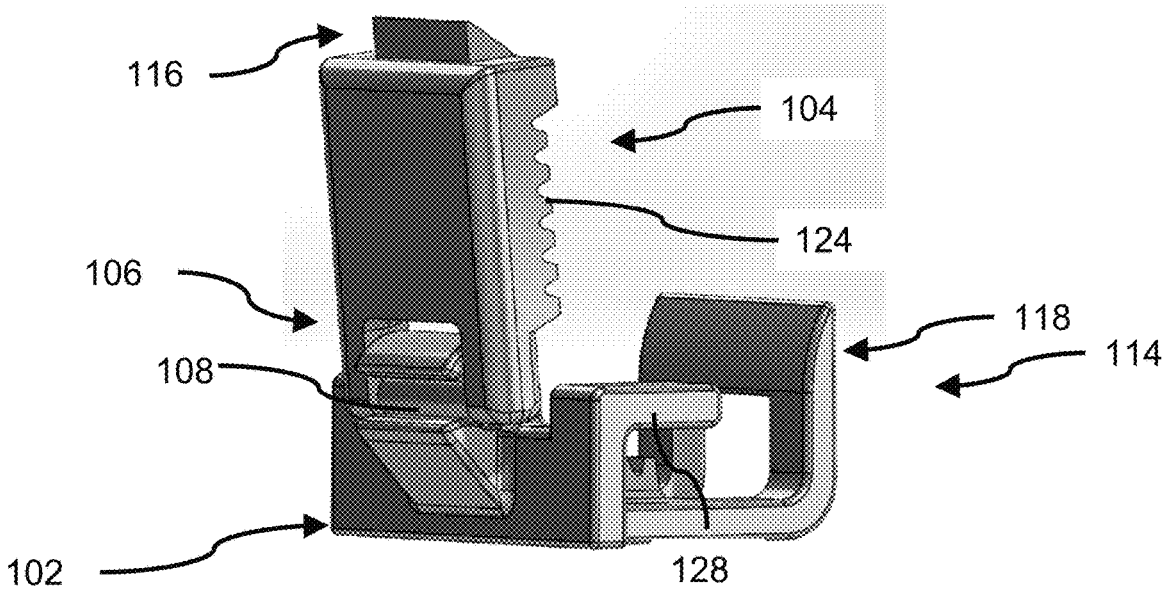
FIG. 7 is another perspective view of the clamp of FIG. 2 in the open configuration.
Figure 8:
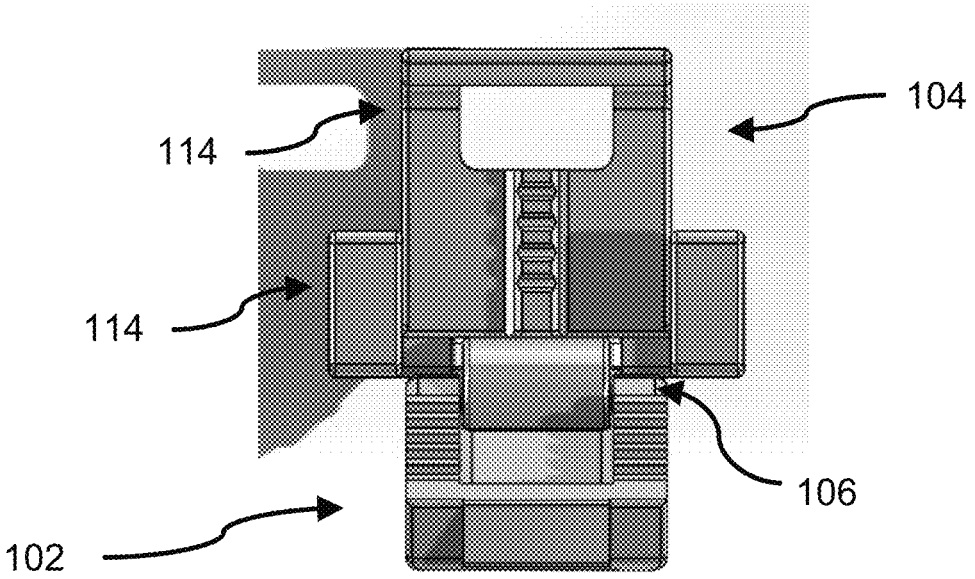
FIG. 8 is a top view of the clamp of FIG. 2 with the cap in the open configuration.
Figure 9:
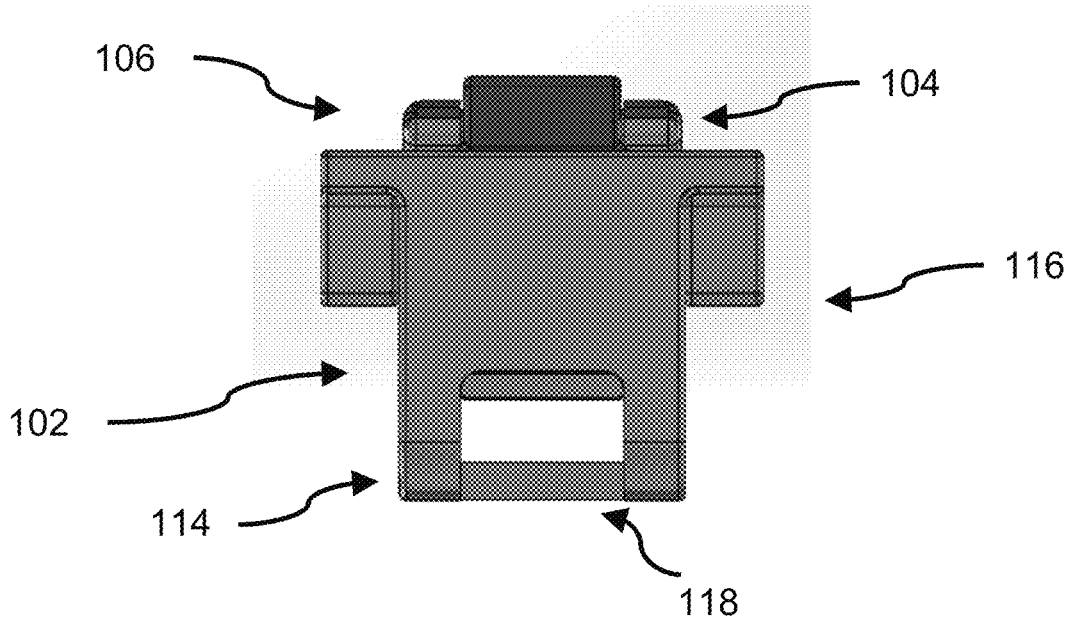
FIG. 9 is a bottom view of the clamp of FIG. 2 with the cap in the open configuration.

Clamp 100 includes a base 102 and a cap 104 pivotally coupled to base 102. Base 102 and cap 104 cooperate to define a hinge 106 including a pin 108 formed in cap 104 and a barrel 110 formed in base 102. Hinge 106 allows clamp 100 to move between an open position shown in FIGS. 1 and 6-9 and a closed position shown in FIG. 3. Base 102 and cap 104 also cooperate to define a snap-fit latch 112 including lever 114 formed on base 102 and a catch 116 formed in cap 104. During movement from the open to closed configurations, lever 114 flexes as a head 118 of lever 114 ramps against catch 116 and snaps into position above catch 116 to hold cap 104 in position as shown in FIG. 3. To release cap 104 from the closed position, a user pulls lever 114 in a direction away from catch 116, so head 118 is no longer positioned over catch 116 allowing cap 104 to move to the open configuration.

As shown in FIGS. 2 and 3, base 102 and cap 104 include staggered sets 122, 124 of teeth. When base 102 and cap 104 are moved between opened and closed configurations, sets 122, 124 of teeth toward and away from each other. Base 102 further includes a pair of arms 128 positioned on each side of set 122 of teeth.

In use, a user positions base 102 against tongue 18 of skate 10 with cap 104 in the open configuration. Next, the user positions one portion of lace 22 under arms 128 and over set 122 of teeth. Next, the user positioned another portion of lace 22 under arms 128 and over set 122 of teeth to form a crisscross pattern with the other portion of lace 22 as shown in FIG. 1. Preferably, lace 22 is tightened to the desired amount. Finally, cap 104 is moved to the closed position so that the portions of lace 22 are trapped between sets 122, 124 of teeth, holding lace 22 in the tightened position. According to the preferred method of using clamps 100, multiple clamps 100 may be provided on each skate 10 as shown in FIG. 1. When multiple clamps 100 are provided, clamps 100 are closed from a bottom of lace 22 toward a top of lace 22 so that lace 22 can be tightened from the bottom to the top and lace 22 can be tied. Clamps 100 are unclamped as described above to allow loosening of lace 22.

According to an alternative method, lace 22 may be completely tightened and tied before clamps 100 are positioned and closed. When using this method, the lace portions are first crisscrossed and base 102 of each clamp is positioned under the crisscrossed portions so they crisscrossed portions fit under arms 128. Next, cap 104 is moved to the closed position. Clamps 100 are unclamped as described above to allow loosening of lace 22.

Figure 10:
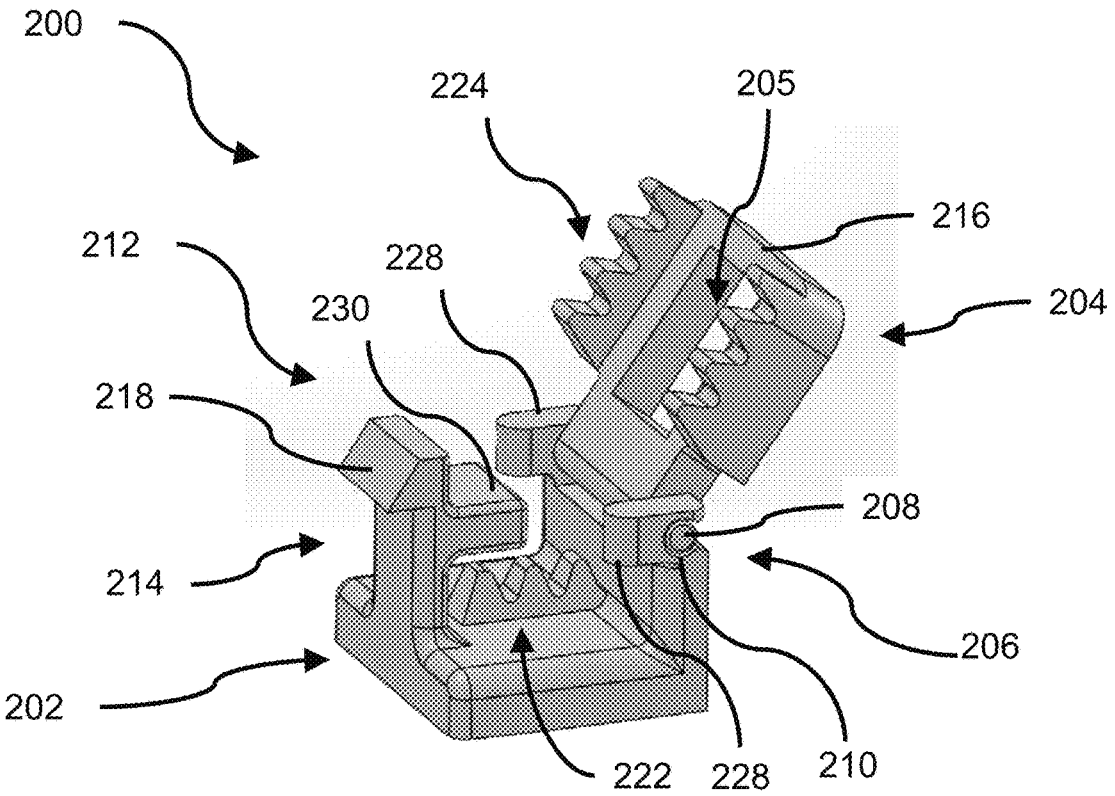
FIG. 10 is a perspective view of another embodiment lace clamp showing the clamp including a base and a cap coupled to the base in an open configuration.
Figure 12:
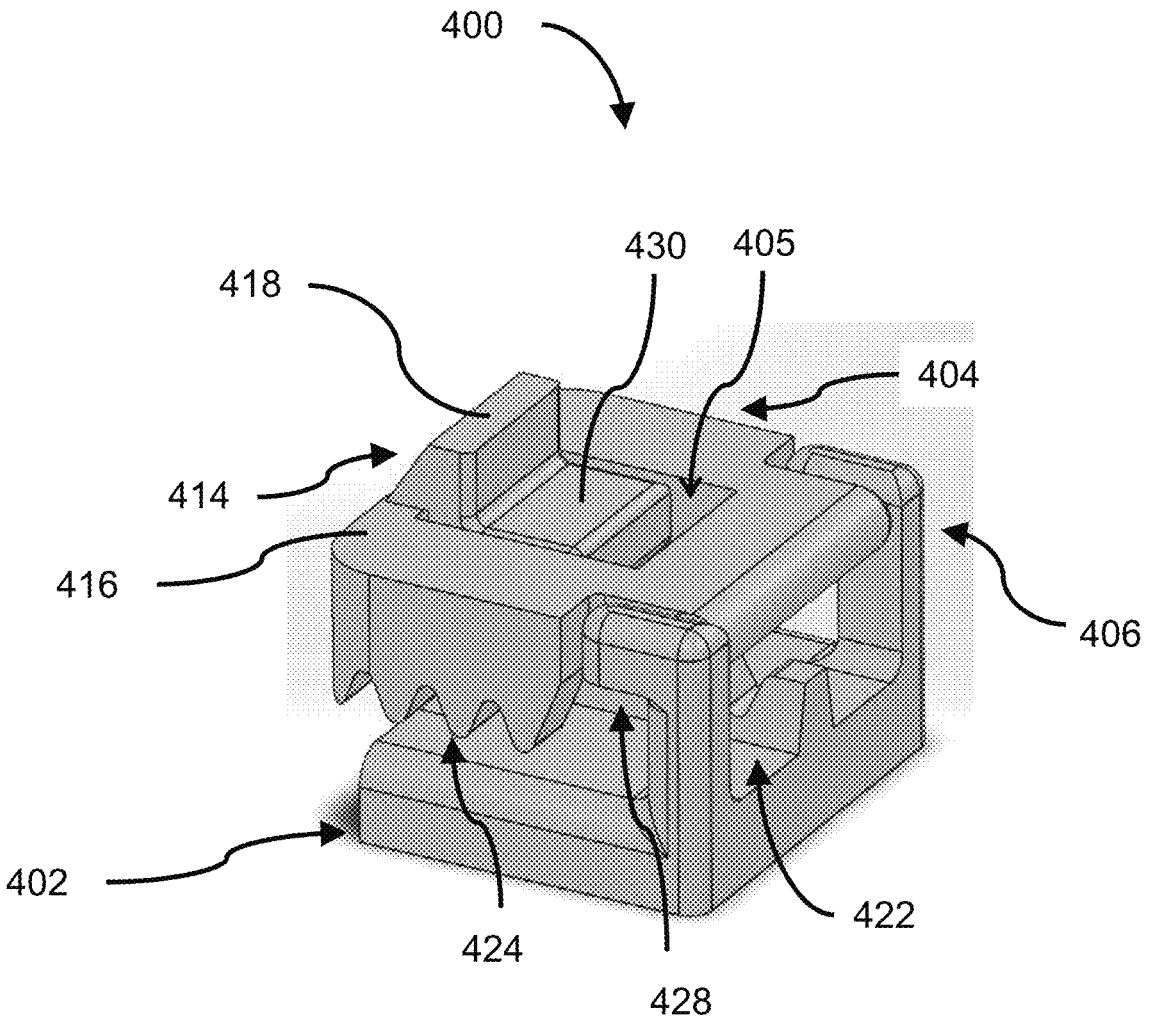
FIG. 12 is a perspective view of another embodiment lace clamp showing the clamp including a base and a cap coupled to the base in an open configuration.

An alternative embodiment clamp 200 is shown in FIG. 10. Clamp 200 is used in the manner described above from clamp 100. Clamp 200 includes a base 202 and a cap 204 pivotally coupled to base 202. Cap 204 may form an opening 205 therein. Base 202 and cap 204 cooperate to define a hinge 206 including a pair of pins 208 formed in cap 204 and a pair of barrels 210 formed in base 202. Hinge 206 allows clamp 200 to move between an open position shown in FIG. 10 and a closed position (not shown). Base 202 and cap 204 also cooperate to define a snap-fit latch 212 including lever 214 formed on base 202 and a catch 216 formed in cap 204. During movement from the open to closed configurations, lever 214 flexes as a head 218 of lever 214 ramps against catch 216 and snaps into position above catch 216 to hold cap 204 in position (see for example FIG. 12 showing a similar latch). To release cap 204 from the closed position, a user pulls lever 214 in a direction away from catch 216 so head 218 is no longer positioned over catch 216 allowing cap 204 to move to the open configuration. Base 202 and cap 204 include staggered sets 222, 224 of teeth. Base 202 further includes a pair of arms 228 positioned on each side of set 222 of teeth and an arm 230 aligned with set 222 of teeth. Arm 230 extends from the lever 214.

Figure 11:
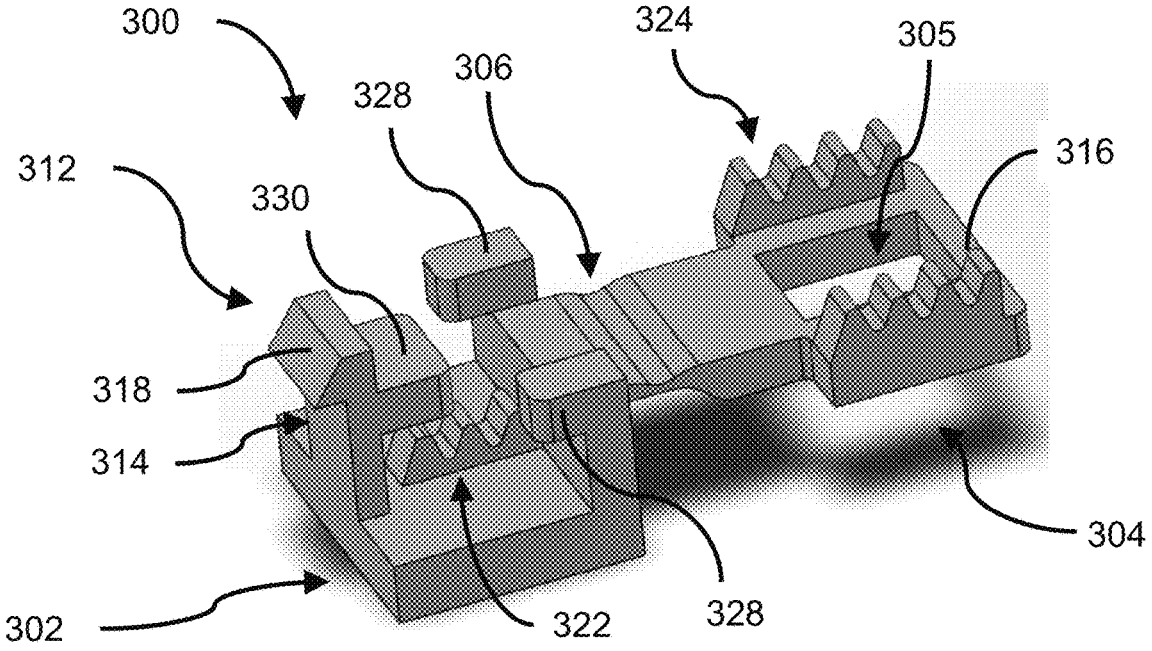
FIG. 11 is a perspective view of another embodiment lace clamp showing the clamp including a base and a cap coupled to the base in an open configuration.

Another alternative embodiment clamp 300 is shown in FIG. 11. Clamp 300 is used in the manner described above from clamp 100. Clamp 300 includes a base 302 and a cap 304 pivotally coupled to base 302. Base 302 and cap 304 cooperate to define a living hinge 306. The thickness of hinge 306 is thinner than base 302 and cap 304. Cap 304 may form an opening 305 therein. Hinge 306 allows clamp 300 to move between an open position shown in FIG. 12 and a closed position (not shown). Base 302 and cap 304 also cooperate to define a snap-fit latch 312 including lever 314 formed on base 302 and a catch 316 formed in cap 304. During movement from the open to closed configurations, lever 314 flexes as a head 318 of lever 314 ramps against catch 316 and snaps into position above catch 316 to hold cap 304 in position (see for example FIG. 12 showing a similar latch). To release cap 304 from the closed position, a user pulls lever 314 in a direction away from catch 316 so head 318 is no longer positioned over catch 316 allowing cap 304 to move to the open configuration. Base 302 and cap 304 include staggered sets 322, 324 of teeth. Base 302 further includes a pair of arms 328 positioned on each side of set 322 of teeth and an arm 330 aligned with set 322 of teeth 322.

An alternative embodiment clamp 400 is shown in FIG. 12. Clamp 400 is used in the manner described above from clamp 100. Clamp 400 includes a base 402 and a cap 404 pivotally coupled to base 402. Cap 404 may form an opening 405 therein. Base 402 and cap 404 cooperate to define a hinge 406 including a pair of pins (not shown) formed in cap 404 and a pair of holes or barrels (not shown) formed in base 402. Hinge 406 allows clamp 400 to move between an open position shown (not shown) and a closed position shown in FIG. 12. Base 402 and cap 404 also cooperate to define a snap-fit latch 412 including lever 414 (see also lever 314 shown in FIG. 11) formed on base 402 and a catch 416 formed in cap 404. During movement from the open to closed configurations, lever 414 flexes as a head 418 of lever 414 ramps against catch 416 and snaps into position above catch 416 to hold cap 404 in position. To release cap 404 from the closed position, a user pulls lever 414 in a direction away from catch 416 so head 418 is no longer positioned over catch 416 allowing cap 404 to move to the open configuration. Base 402 and cap 404 include staggered sets 422, 424 of teeth. Base 402 further includes a pair of arms 428 positioned on each side of set 422 of teeth and an arm 430 aligned with set 422 of teeth.

Figure 13A:
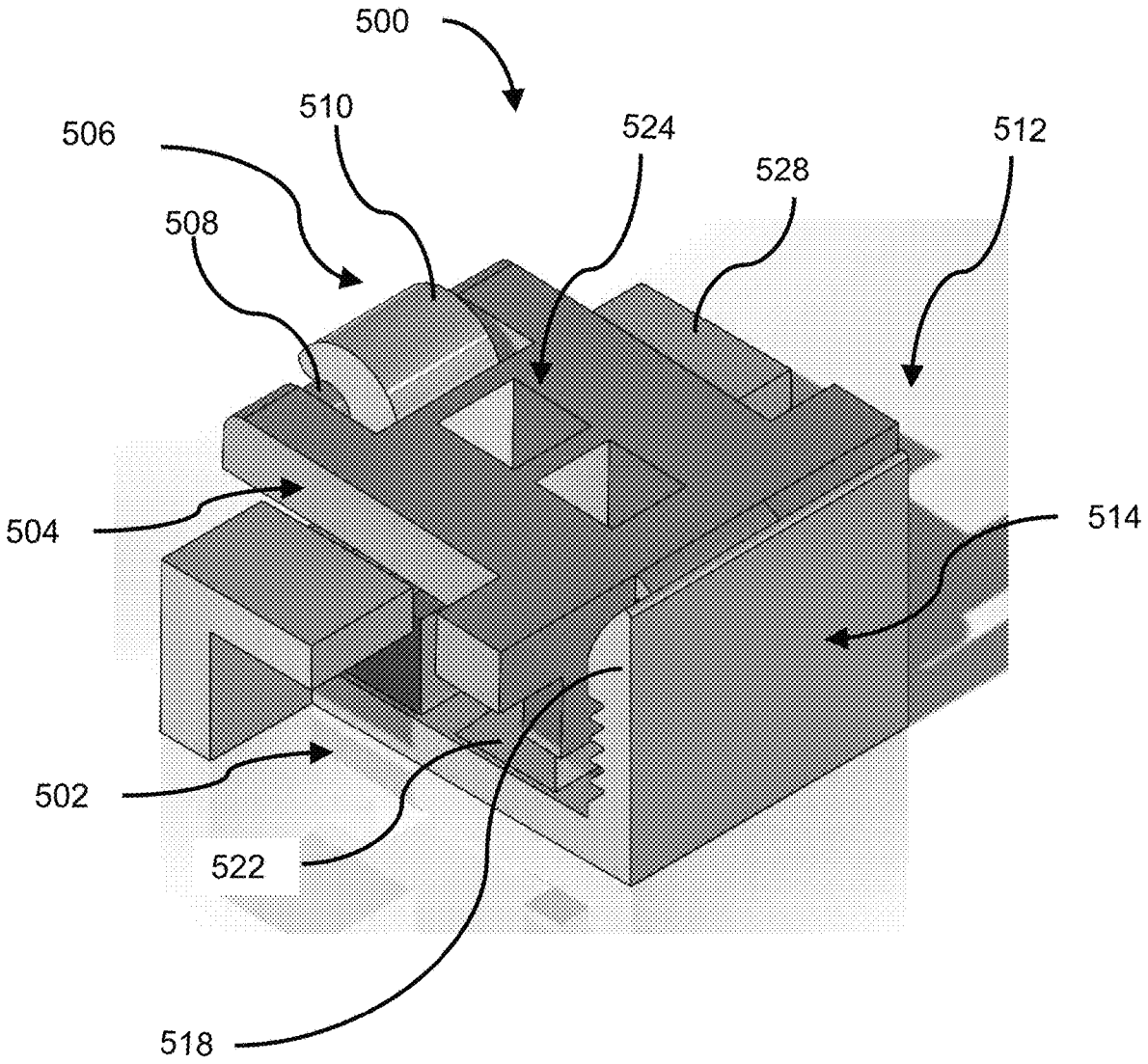
FIG. 13A is a perspective view of another embodiment lace clamp showing the clamp including a base and cap coupled to the base in a closed configuration.
Figure 13B:
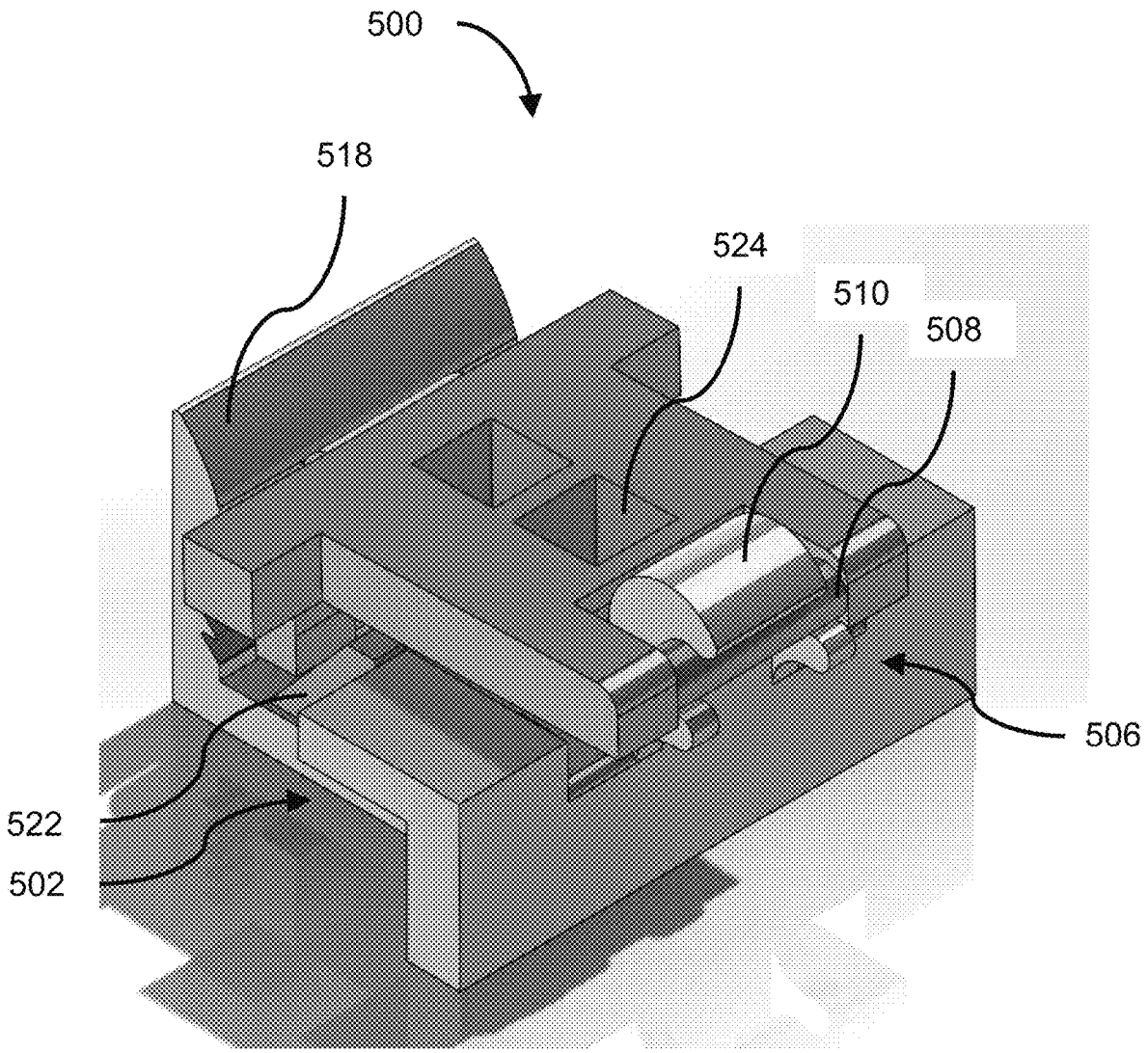
FIG. 13B is an opposite perspective view of the clamp of FIG. 13A.
Figure 13C:
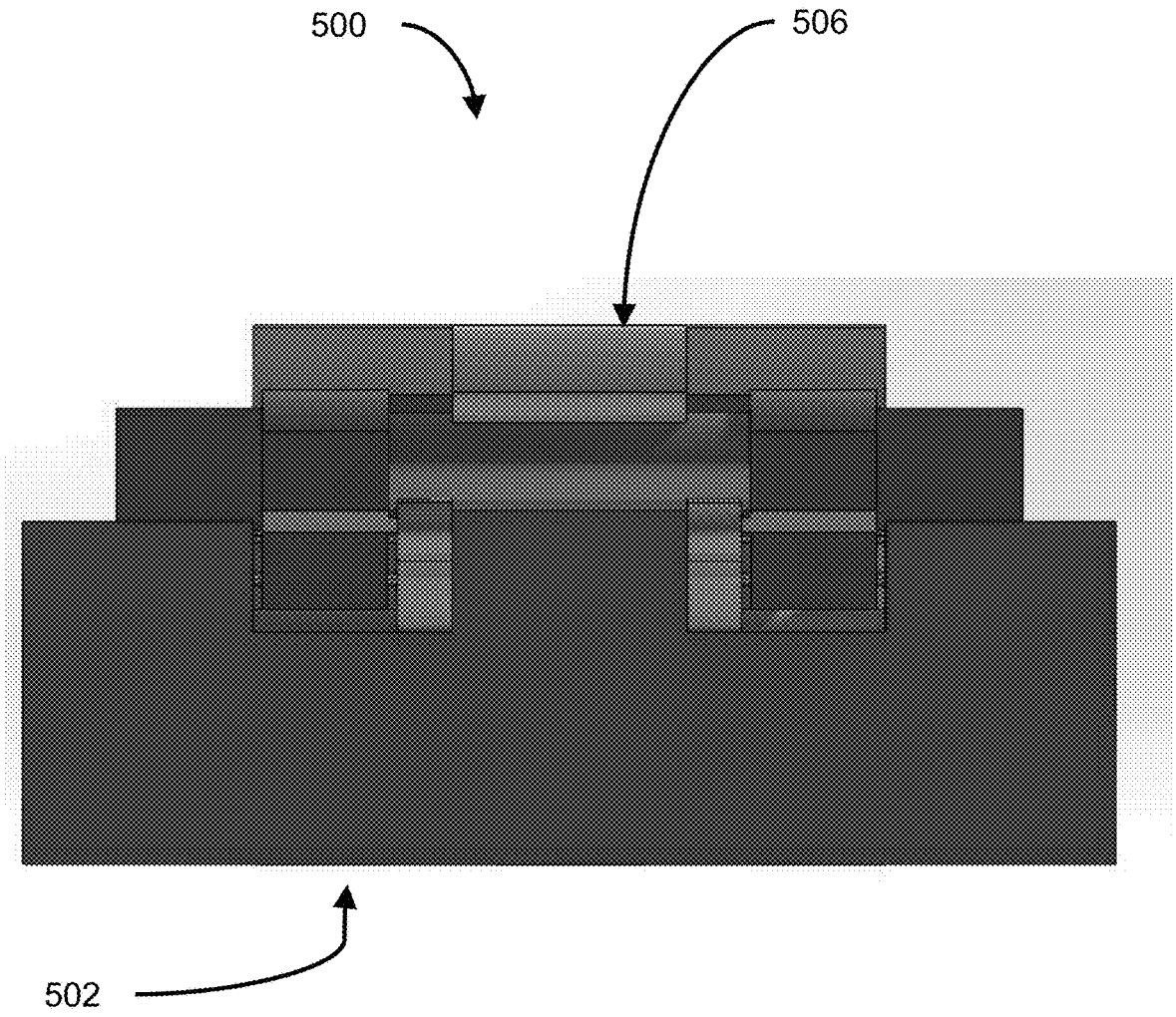
FIG. 13C is a rear end view of the clamp of FIG. 13A in the closed configuration.
Figure 13D:
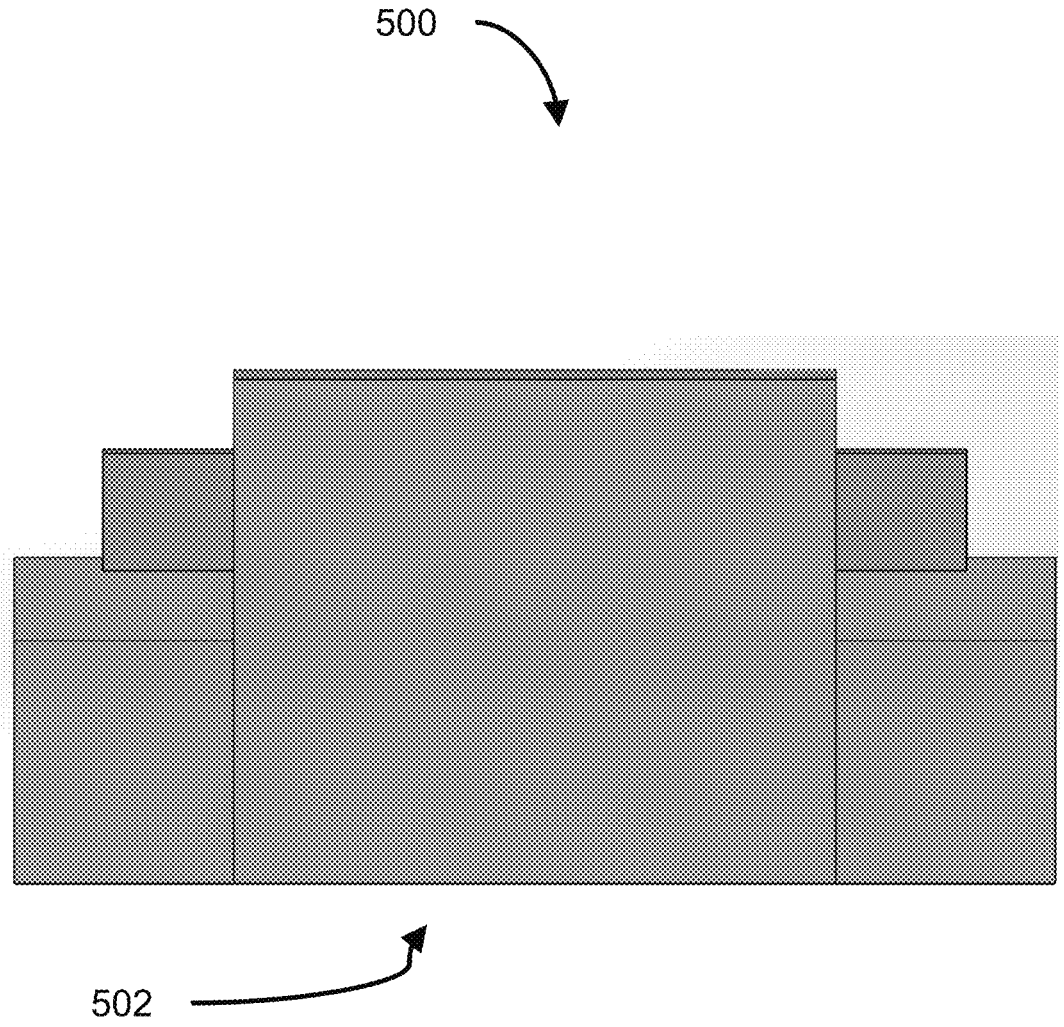
FIG. 13D is a front end view of the clamp of FIG. 13A in the closed configuration.
Figure 13E:
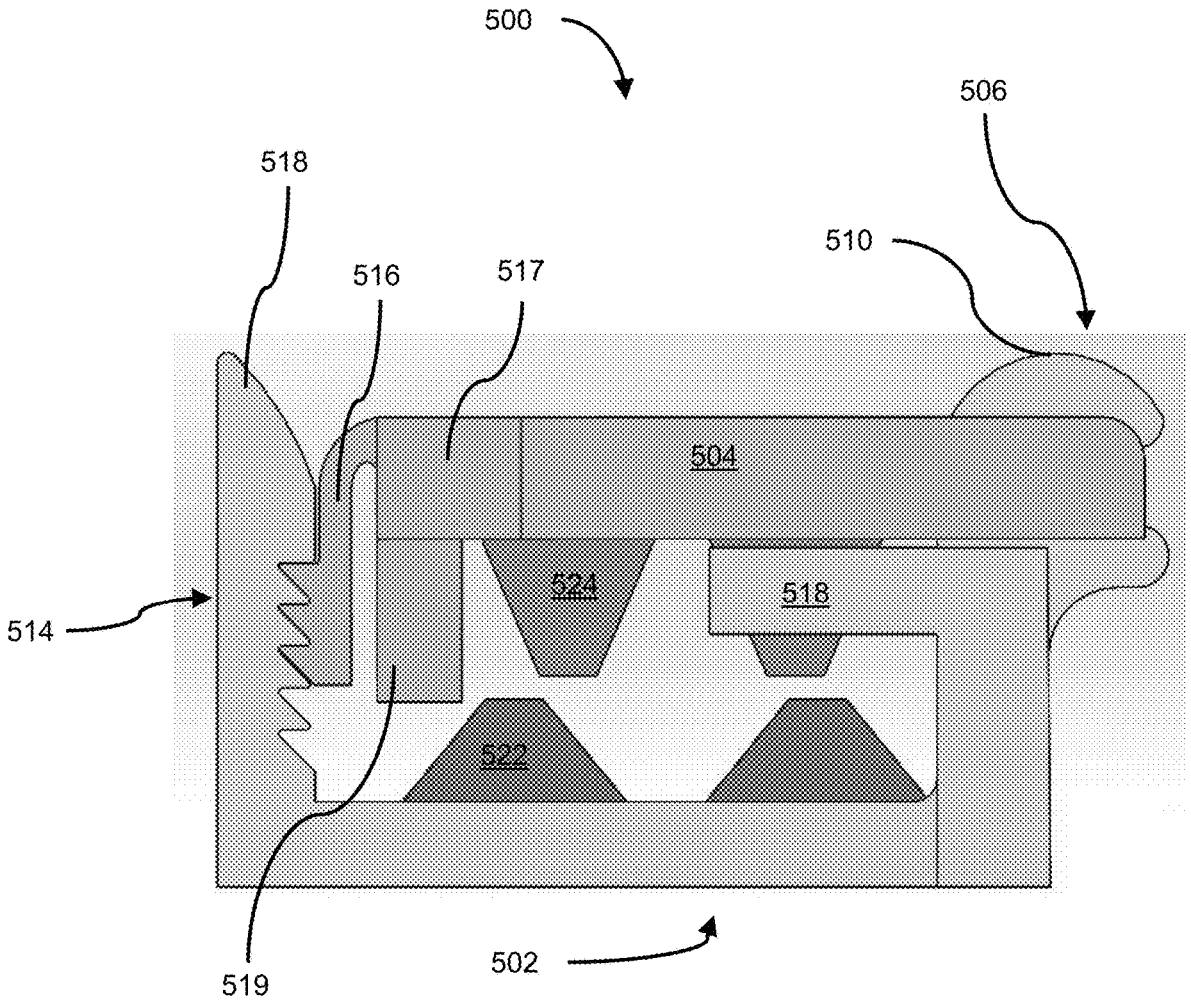
FIG. 13E is a side view of the clamp of FIG. 13A in the closed configuration.
Figure 13F:
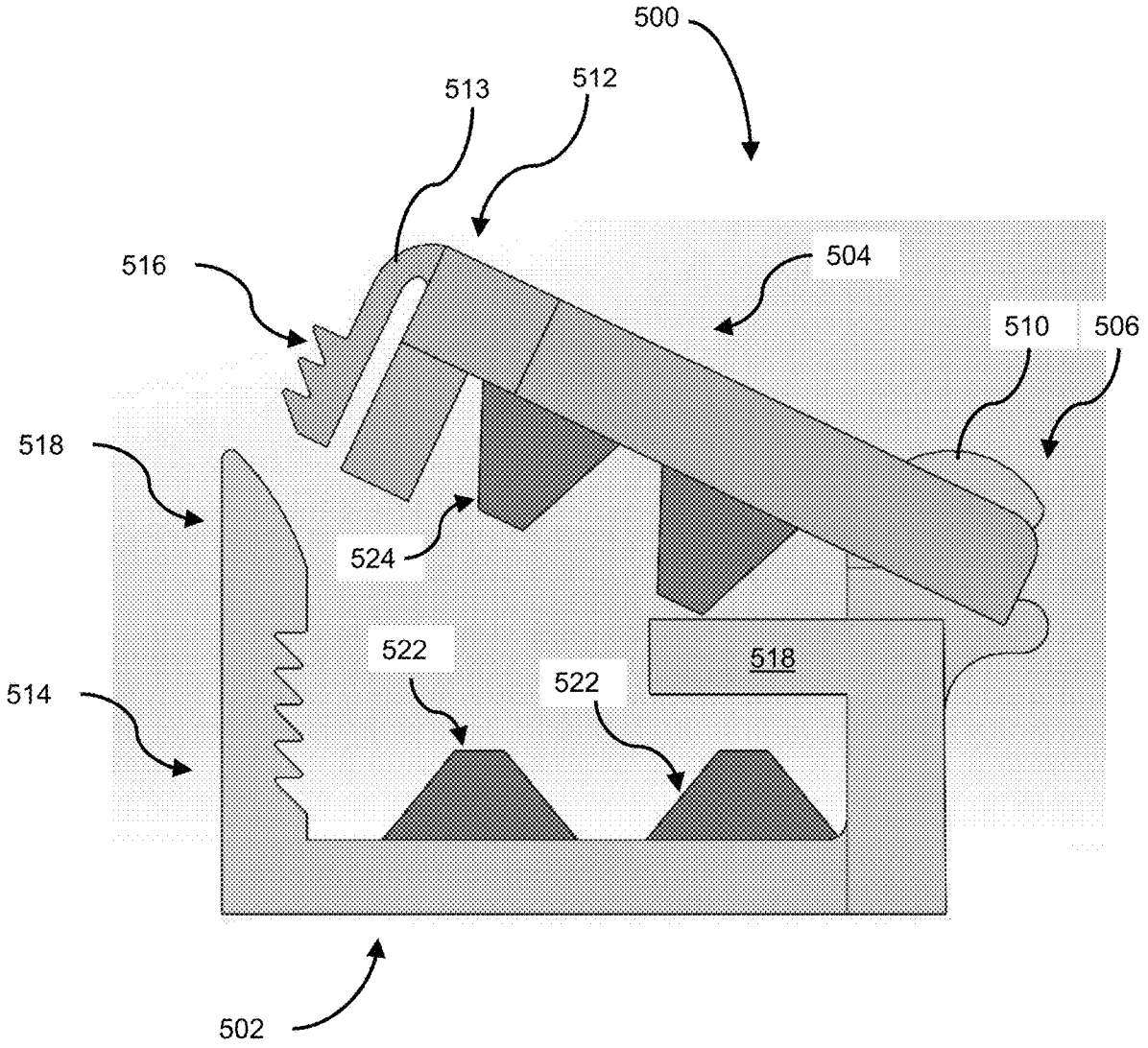
FIG. 13F is another side view of the clamp of FIG. 13A in an open configuration.
Figure 13G:
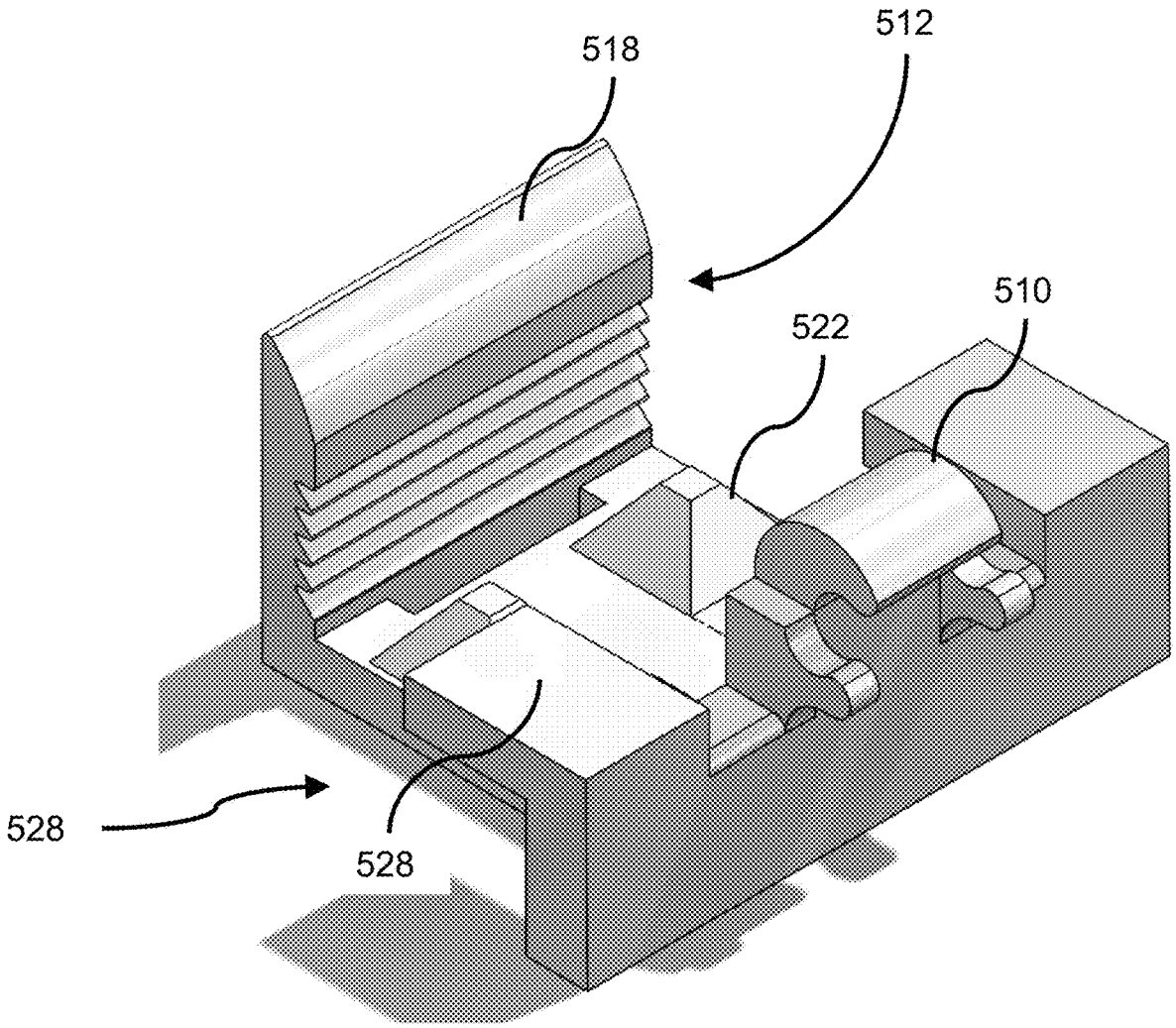
FIG. 13G is a perspective view of the base of the clamp in FIG. 13A without the cap.
Figure 13H:
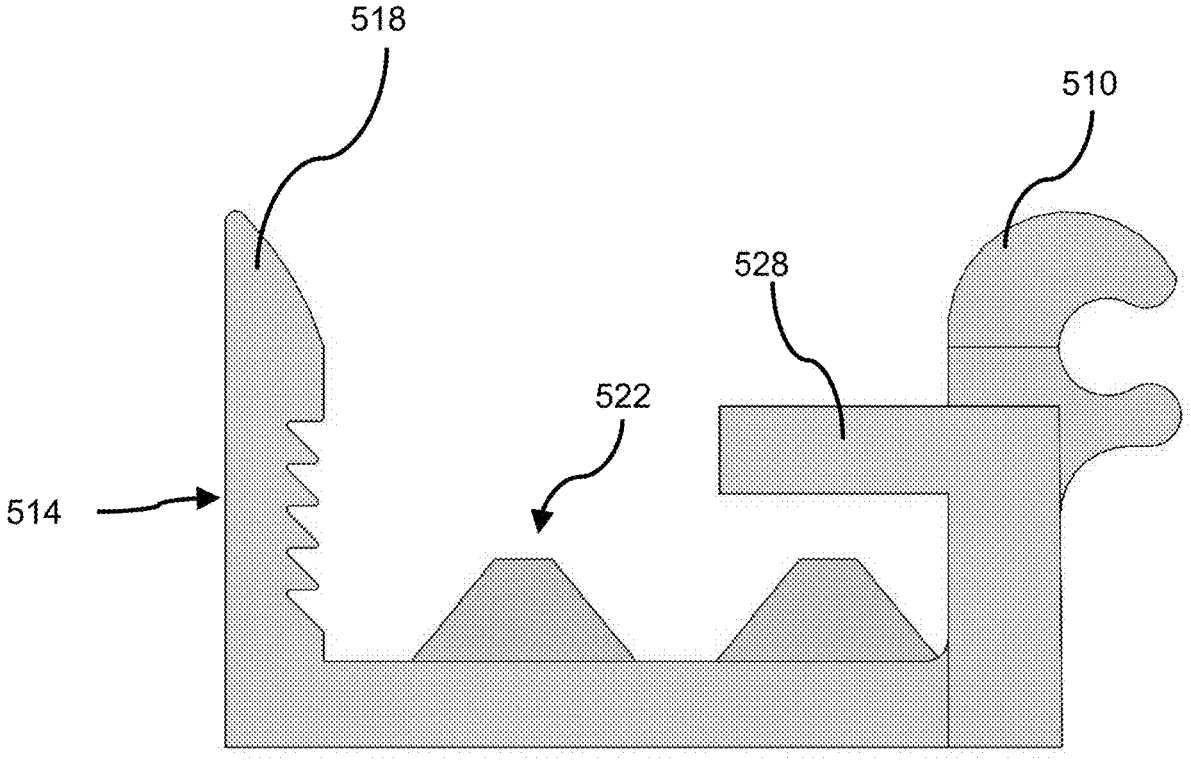
FIG. 13H is a side view of the base of the clamp in FIG. 13A without the cap.
Figure 13I:
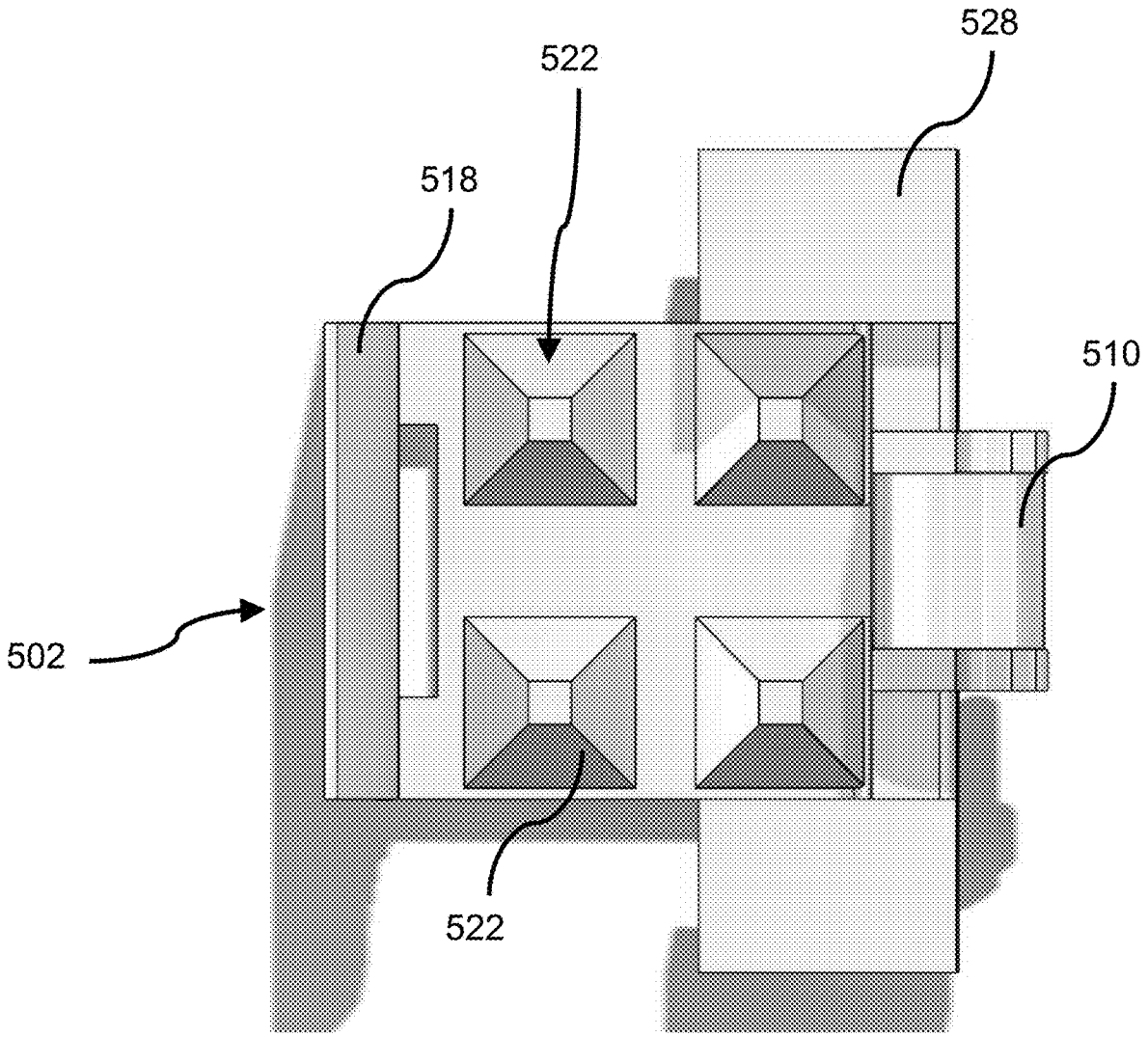
FIG. 13I is a top view of the base the clamp in FIG. 13A.

An alternative embodiment clamp 500 is shown in FIG. 13A. Clamp 500 is used in the manner described above from clamp 100. Clamp 500 includes a base 502 and a cap 504 pivotally coupled to base 502. Base 502 and cap 504 cooperate to define a hinge 506. Hinge 506 allows clamp 500 to move between an open position shown in FIG. 13F and a closed position shown in FIGS. 13A-F and J. Hinge 506 includes a barrel 510 and a pin 508. Barrel 510 receive pin 508 to allow cap 504 and base 502 to pivot with each other. Base 502 and cap 504 also cooperate to define a snap-fit latch 512 including lever 514 formed on base 502 and a toothed catch 516 (as shown in FIG. 13E) formed in cap 504. Lever 514 can be toothed on its surface facing hinge 506. Catch 516 and cap 504 define a catch hinge 513 as shown in FIG. 13F, so that catch 516 can pivot relatively to cap 504. Catch hinge 513 can be a living hinge. During movement from the open to closed configurations, lever 514 flexes as a head 518 of lever 514 ramps against catch 516 and snaps into position above catch 516 to hold cap 504 in position as shown in FIG. 13E. To release cap 504 from the closed position, a user pulls lever 514 in a direction away from catch 516 so head 518 is no longer positioned over catch 516 allowing cap 504 to move to the open configuration.

Figure 13J:
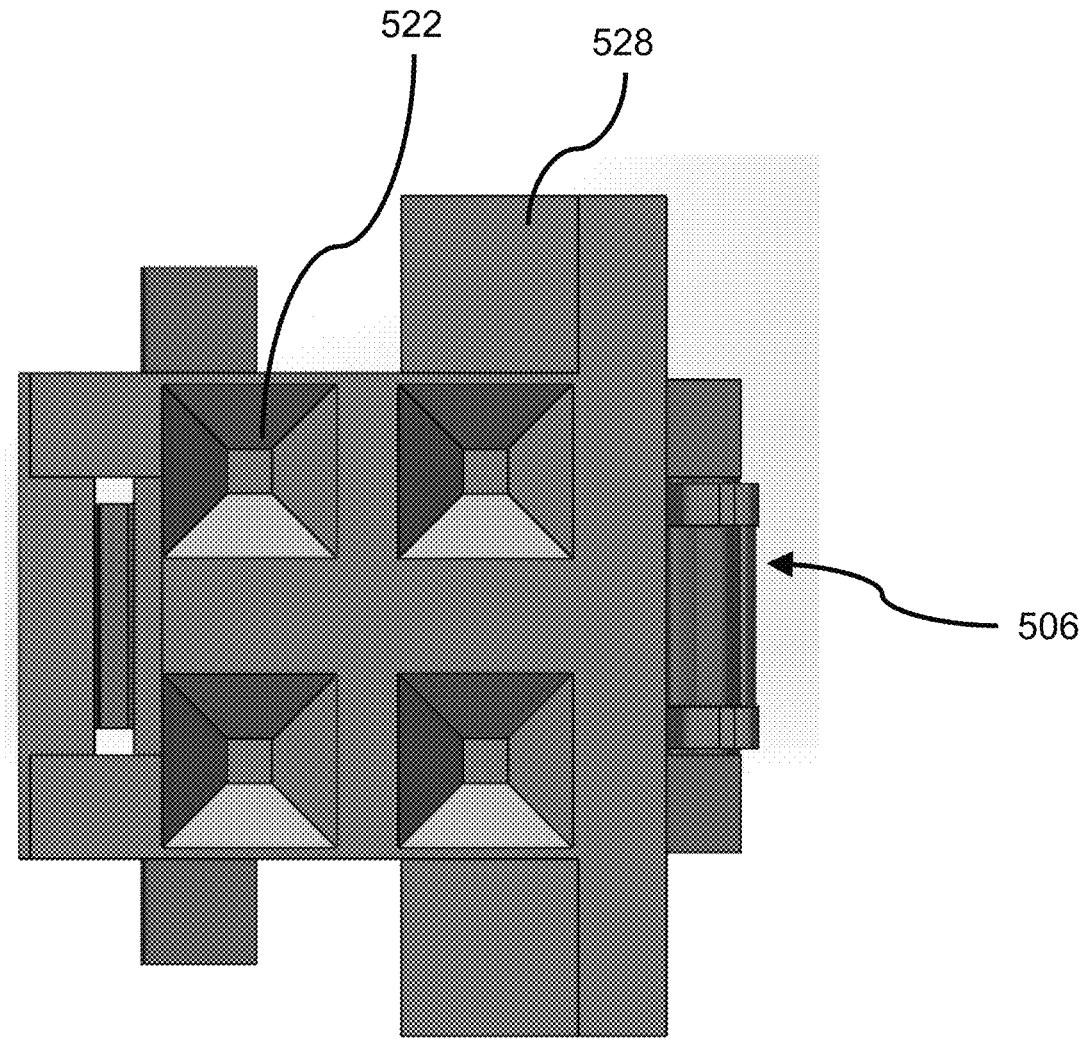
FIG. 13J is a bottom view of the underside of the base of the clamp in FIG. 13A.
Figure 13K:
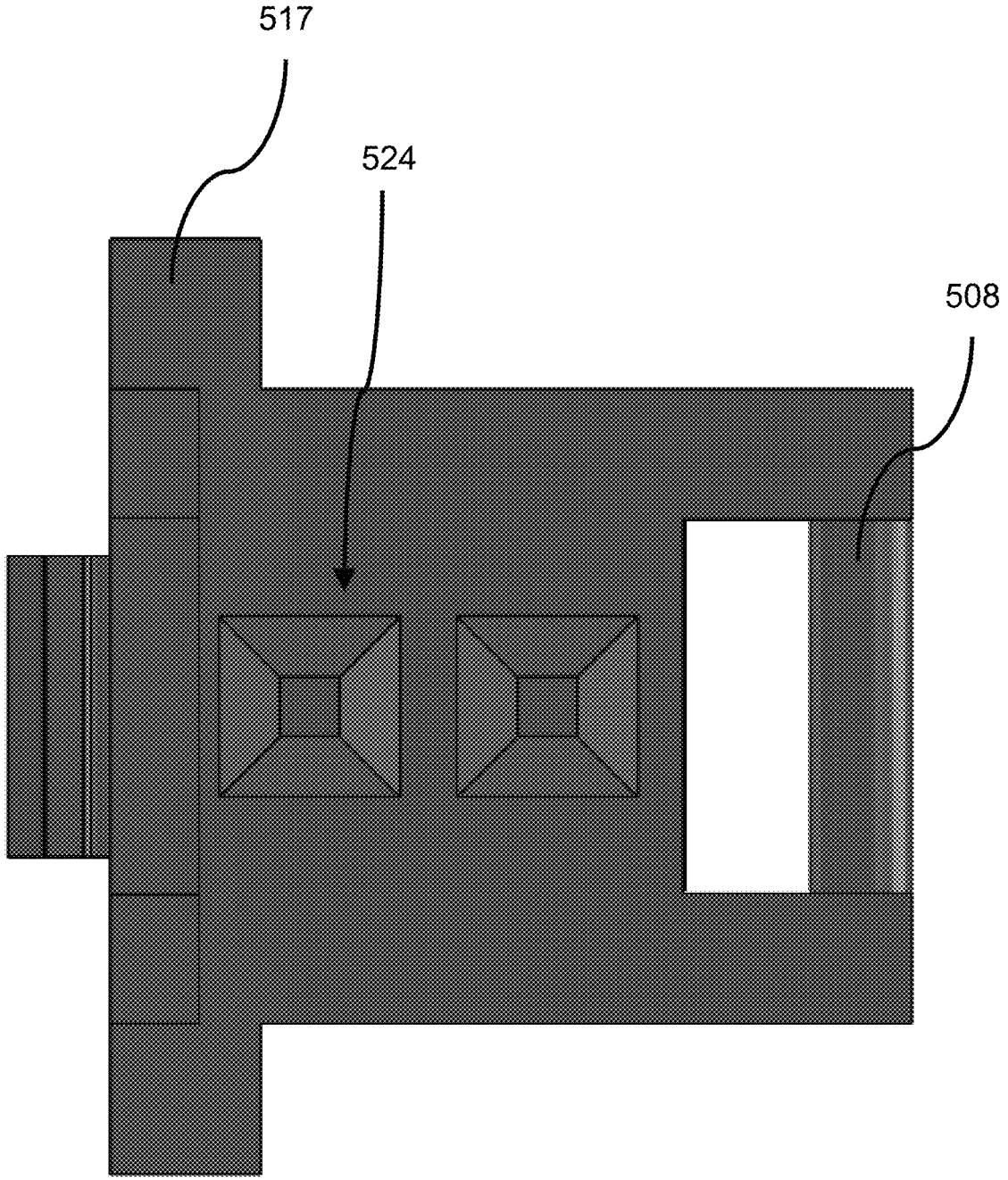
FIG. 13K is a bottom view of the cap of the clamp of FIG. 13A without the base.
Figure 13L:
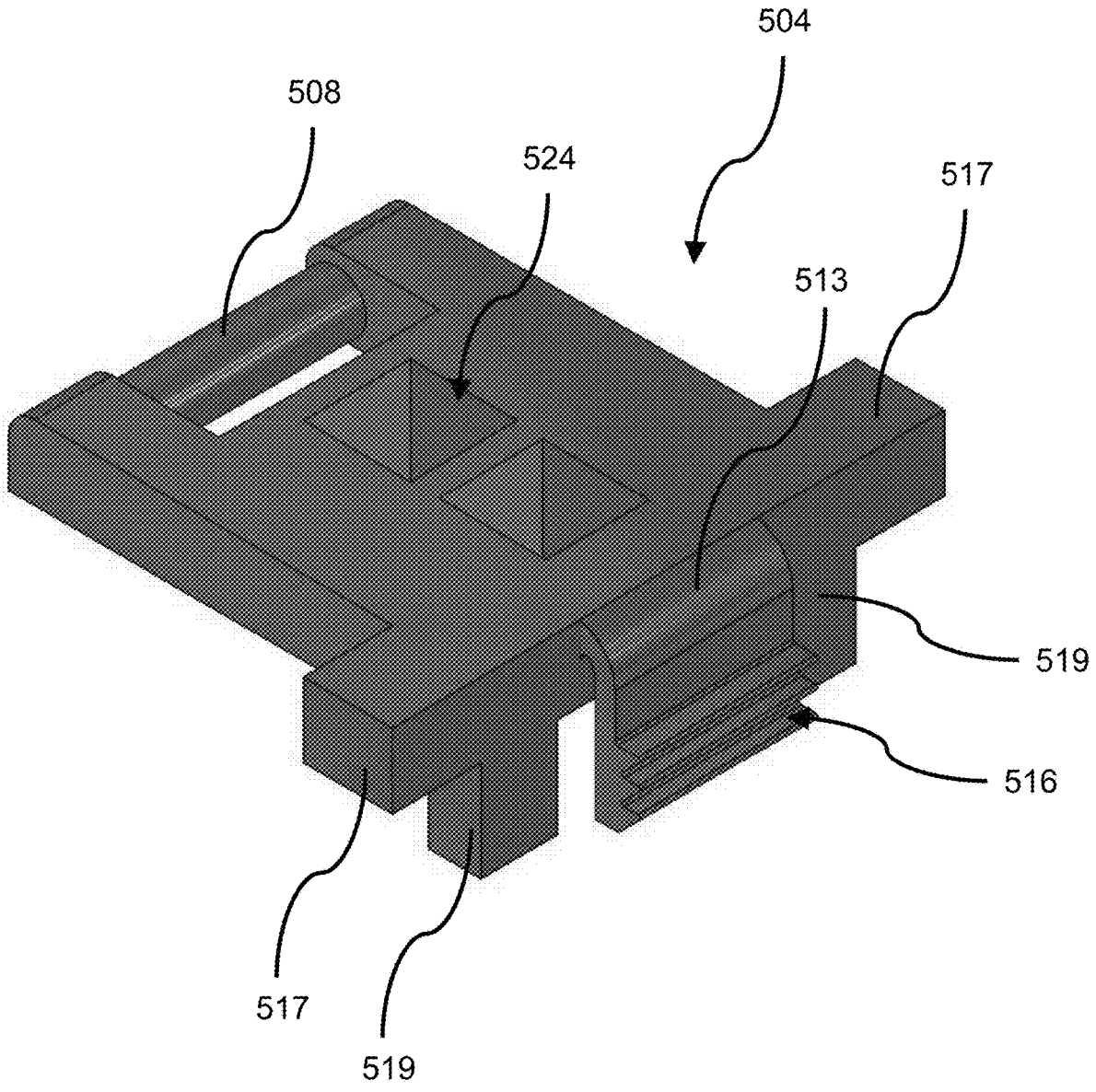
FIG. 13L is a perspective view of the cap of the clamp of FIG. 13A without the base.
Figure 13M:
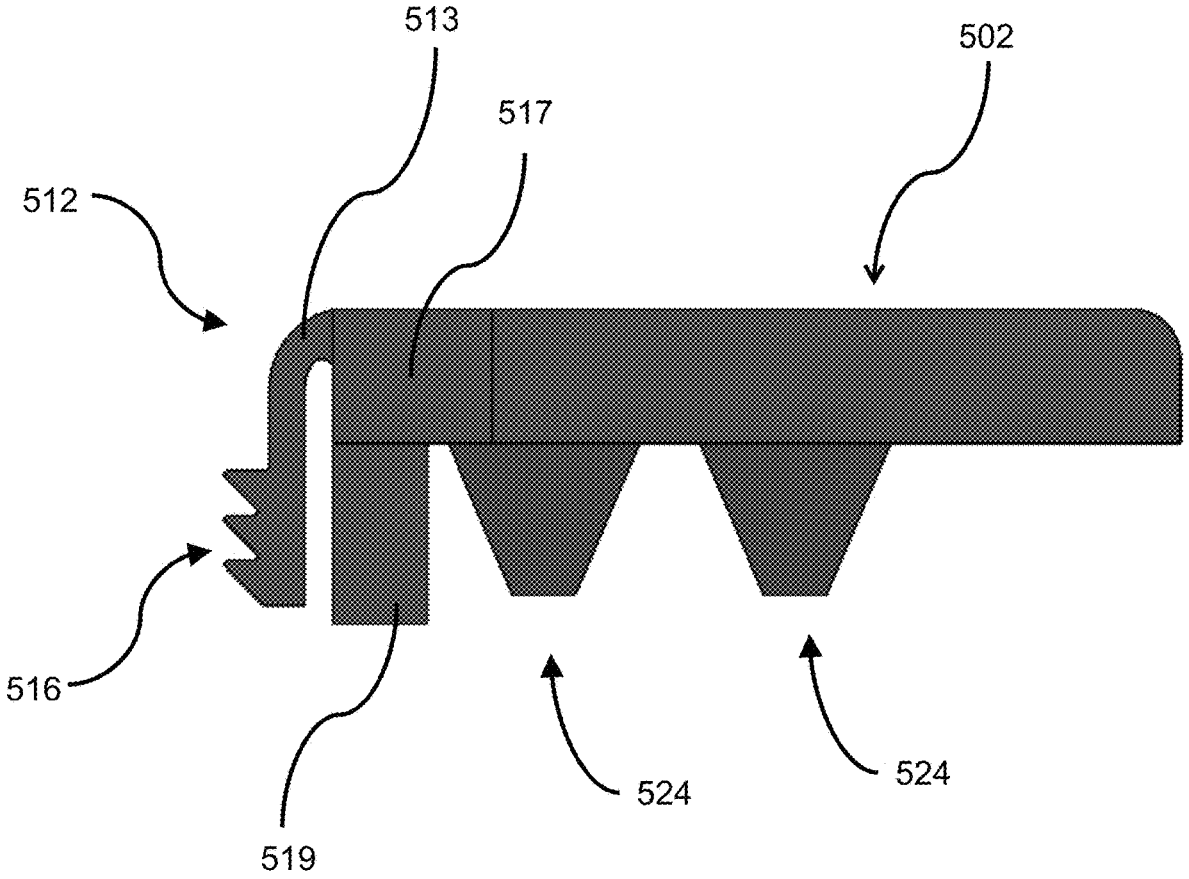
FIG. 13M is a side view of the cap of the clamp of FIG. 13A without the base.

Base 502 and cap 504 include staggered sets 522, 524 of teeth. Staggered sets 522, 524 can be substantially pyramid-shaped. Staggered sets 522,524 can have substantially flat tops. Staggered sets 522, 524 can be hollowed as shown in FIG. 13J and FIG. 13L. Staggered sets 522 may include four pyramid-shaped teeth or protrusions on base 502, and staggered sets 524 may include two pyramid-shaped teeth or protrusions on cap 504. Two pyramid-shaped protrusions on cap 502 are placed between four pyramid-shaped protrusions on base 502 when clamp 500 is the closed position. Base 502 further includes a pair of arms 528 positioned on each side of set 522 of teeth. As shown in FIG. 13L, cap 504 further include horizontal arms 517 extending from an end of cap 504 close to catch 516. Horizontal arms 517 are spaced apart by staggered sets 524. Cap 504 further include vertical arms 519 extending from the end of cap 504 close to catch 516. Vertical arms 519 are spaced apart by staggered sets 524 and may be substantially parallel to catch 516.

Figure 14A:
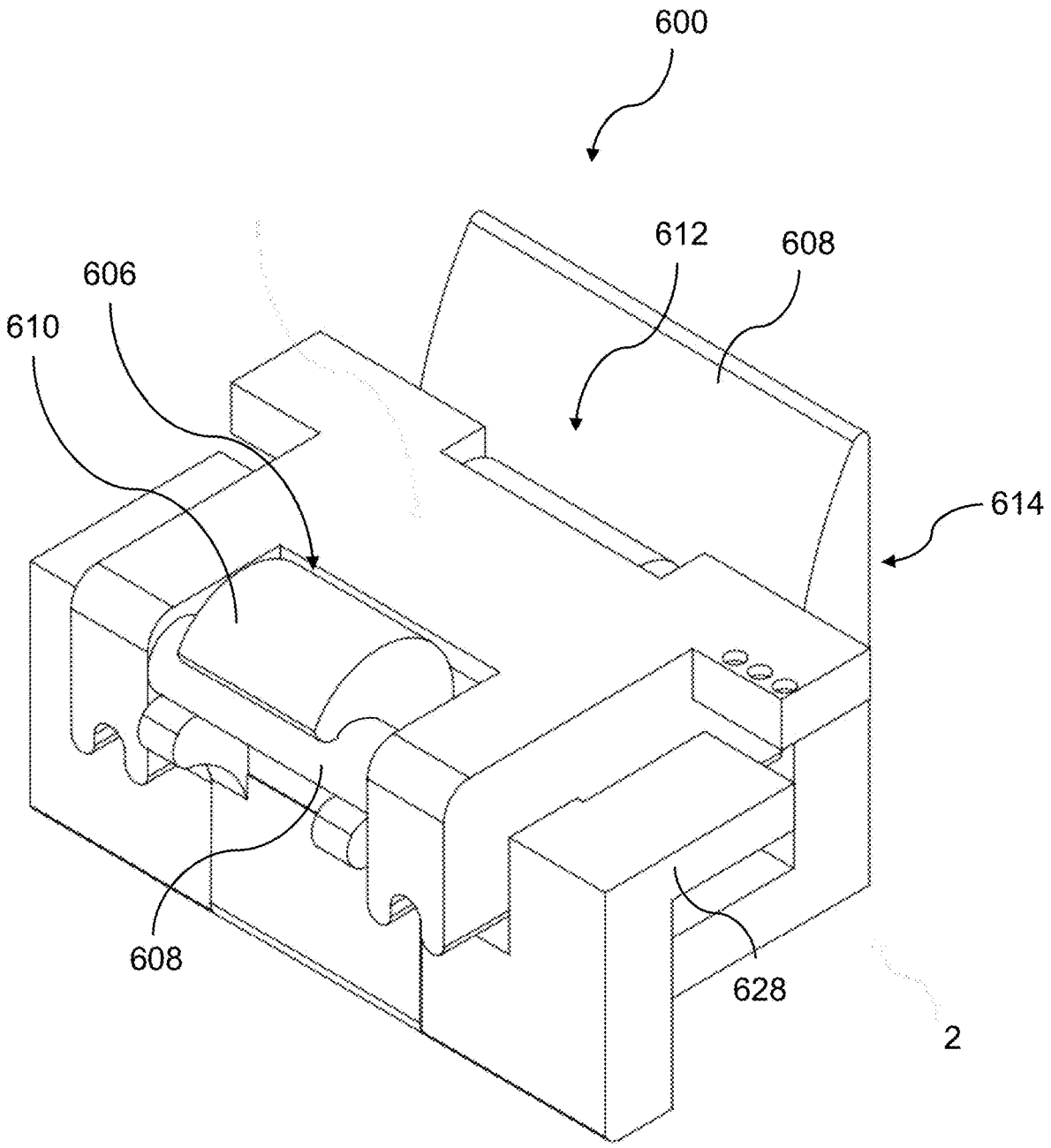
FIG. 14A is a perspective view of another embodiment lace clamp showing the clamp including a base and cap coupled to the base in a closed configuration.
Figure 14B:
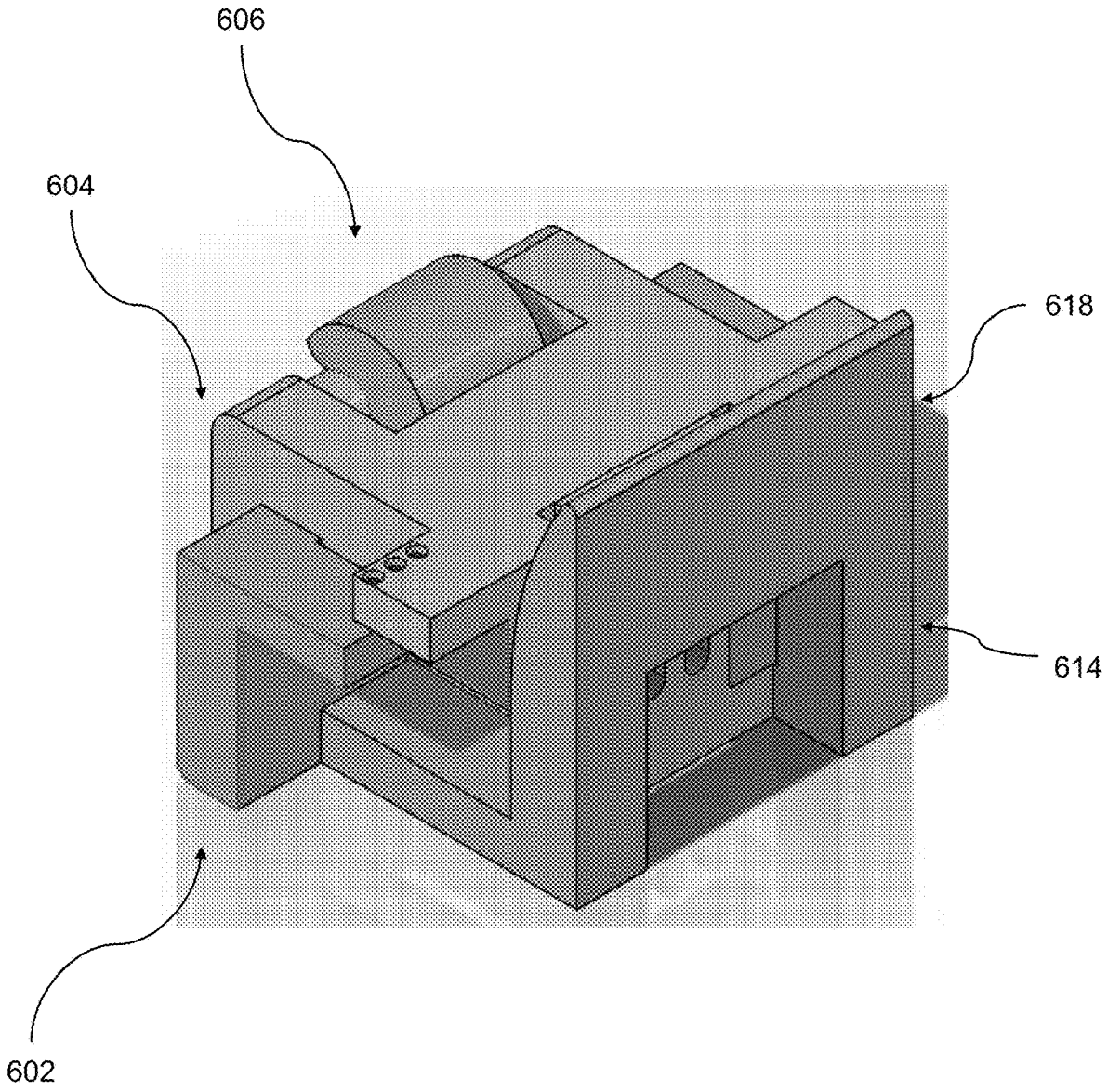
FIG. 14B is an opposite perspective view of the clamp of FIG. 14A.
Figure 14C:
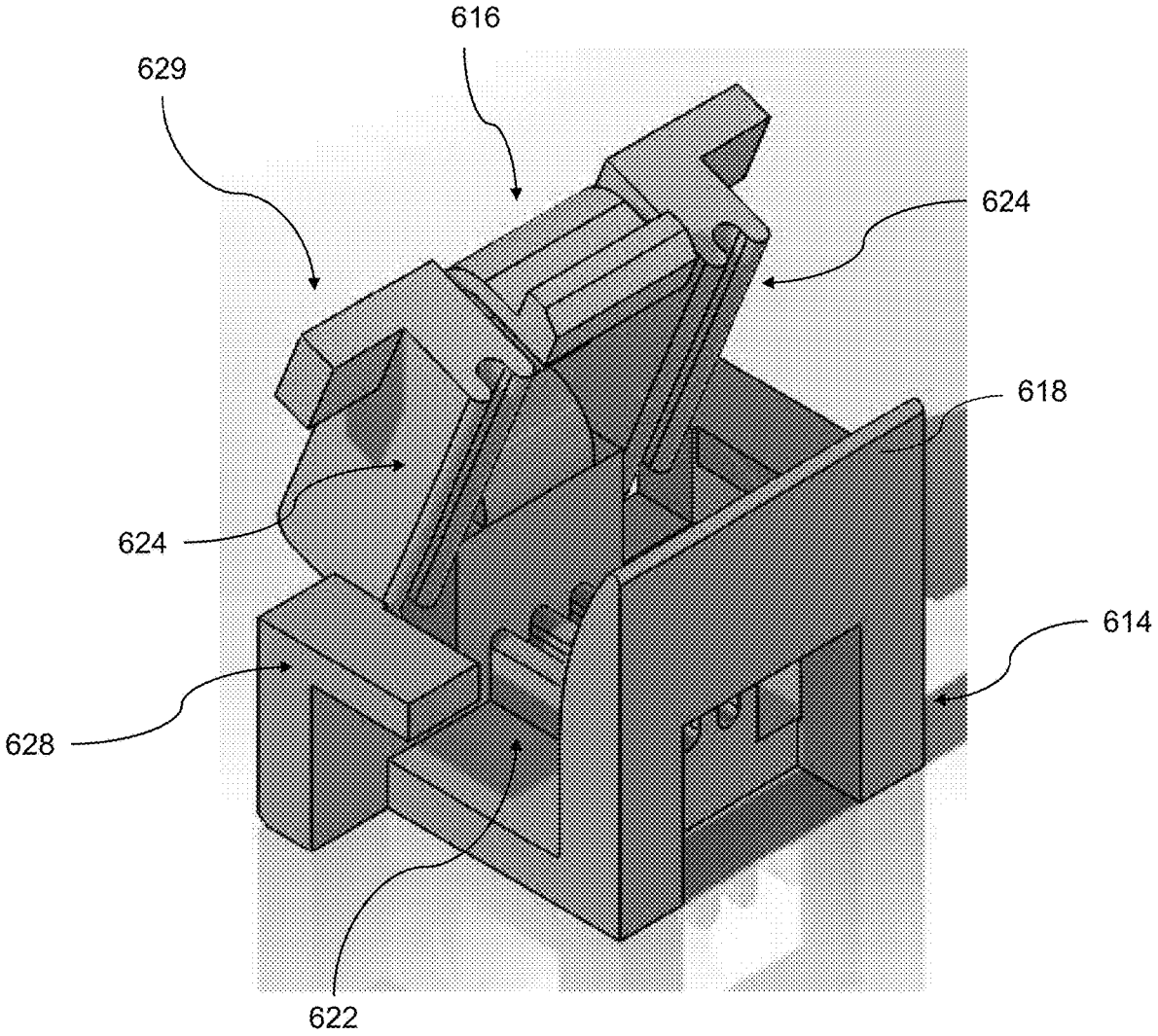
FIG. 14C is another perspective view of the clamp of FIG. 14A showing the clamp in an open configuration.
Figure 14D:
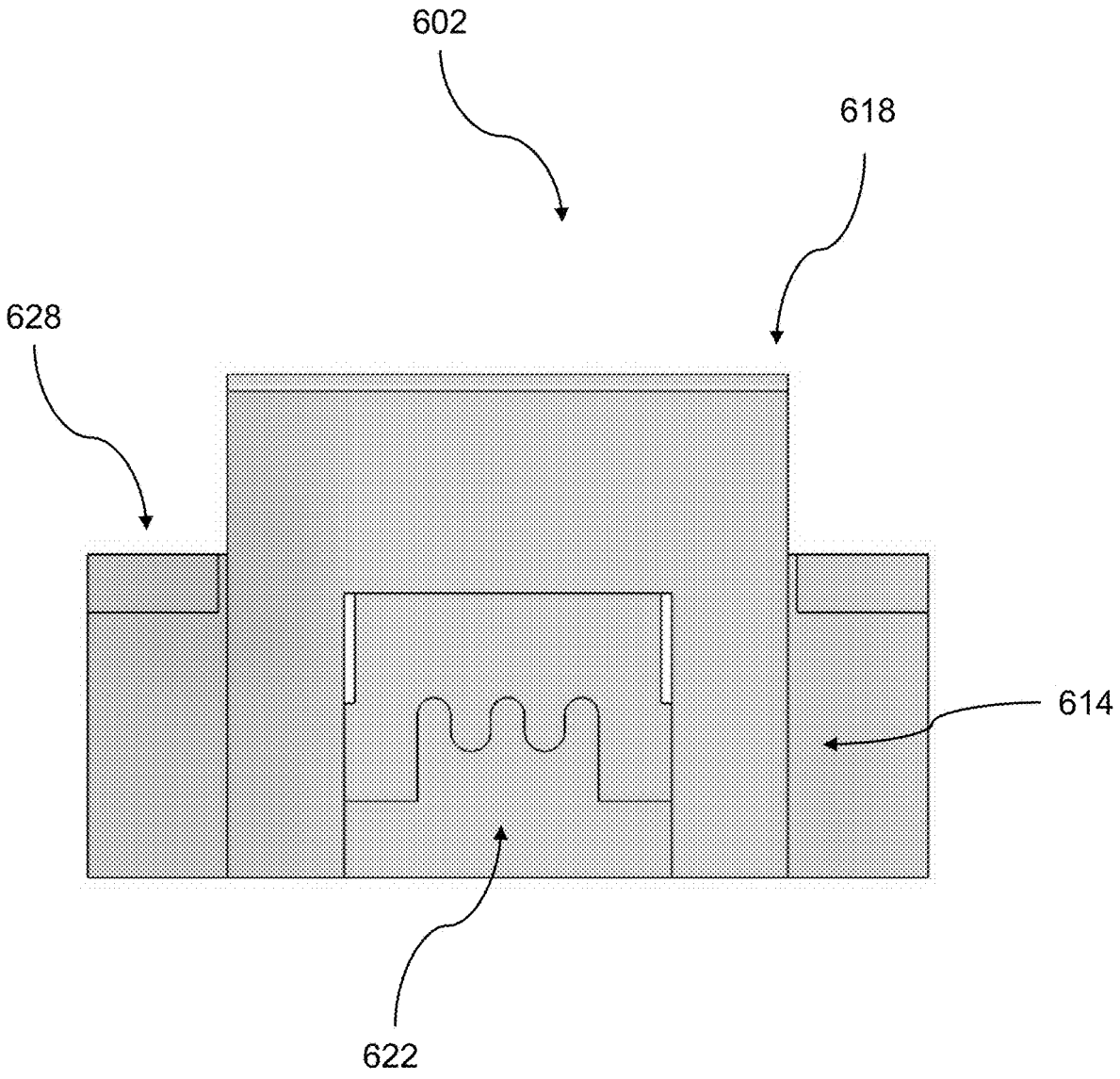
FIG. 14D is an end view of the base of clamp in FIG. 14A without the cap.
Figure 14E:
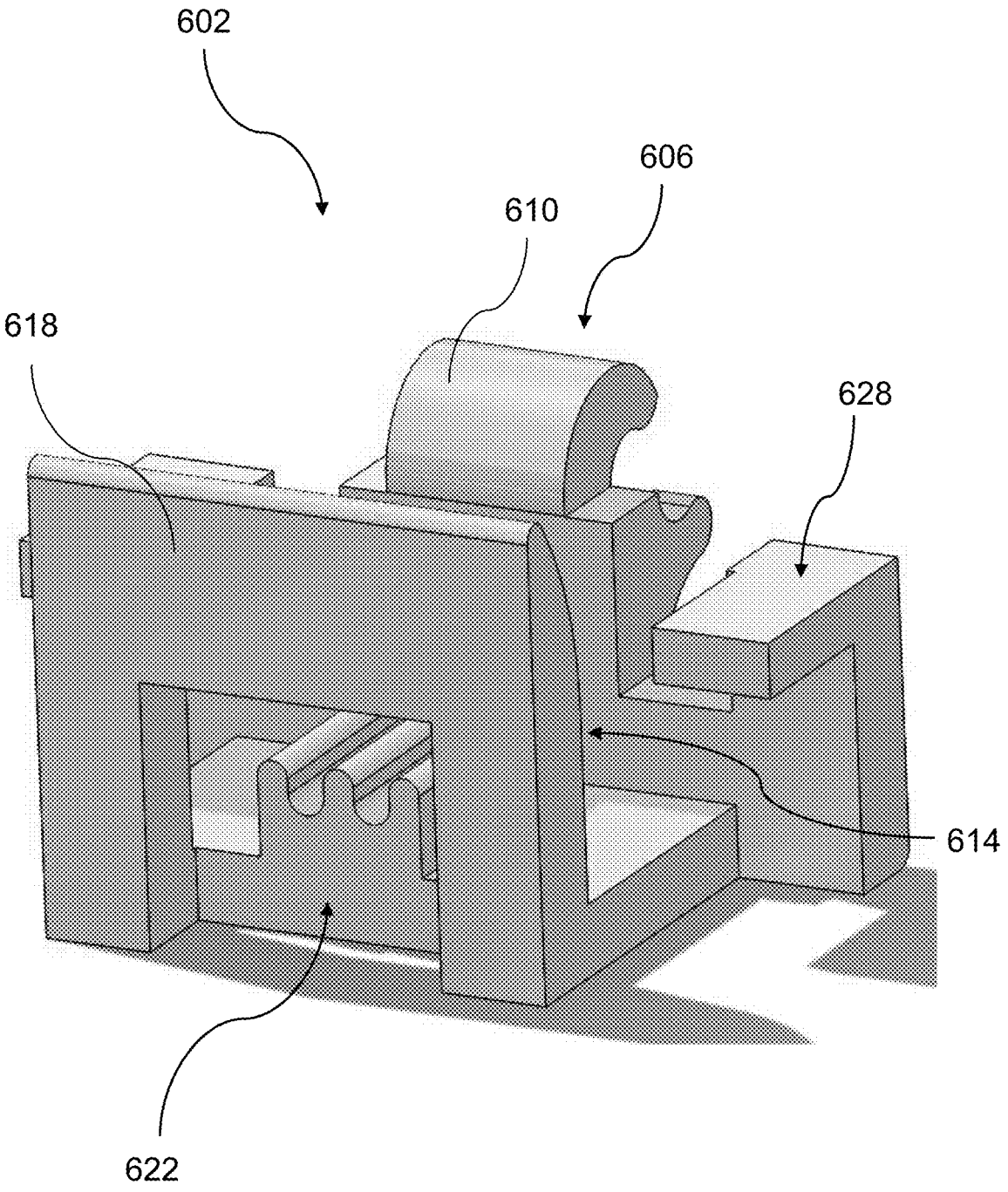
FIG. 14E is a perspective view of the base of the clamp in FIG. 14A without the cap.
Figure 14F:
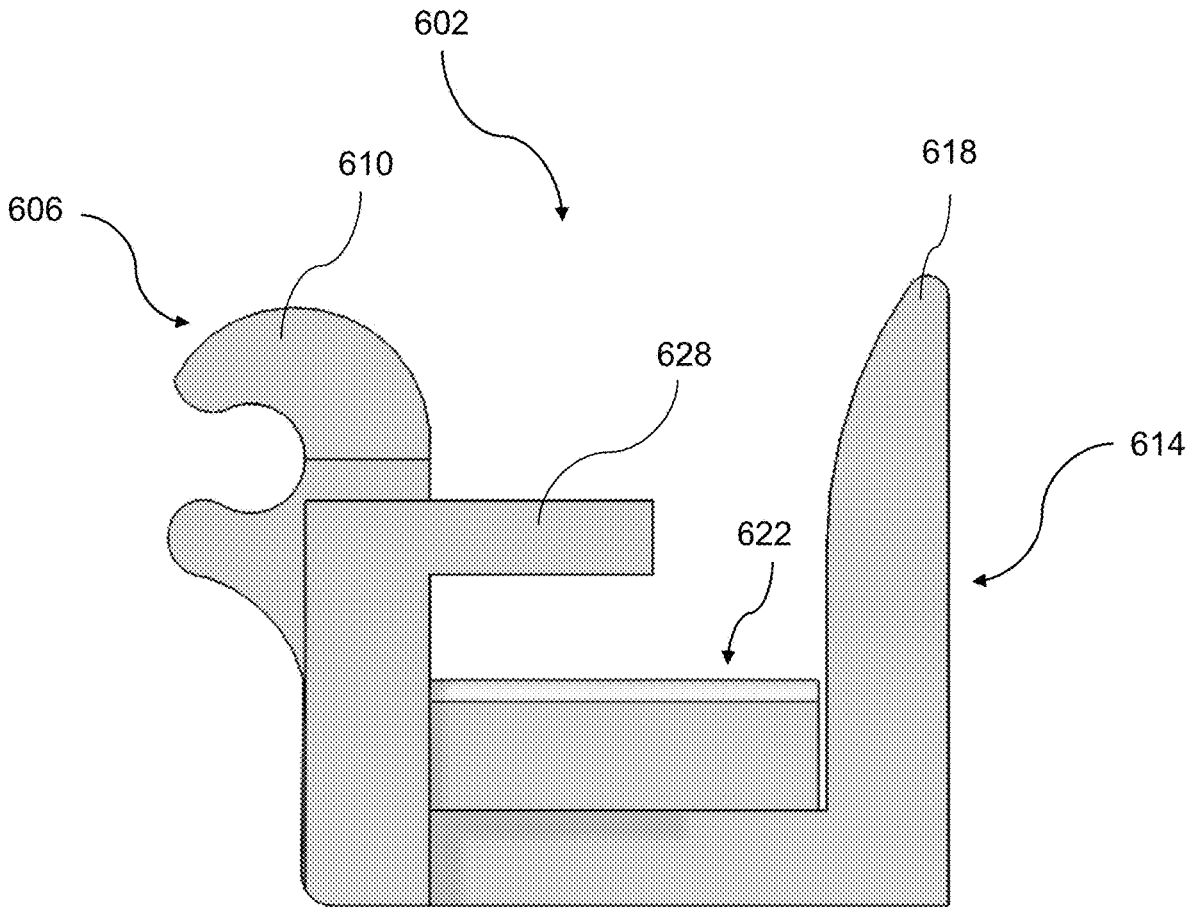
FIG. 14F is a side view of the base of the clamp in FIG. 14A without the cap.

An alternative embodiment clamp 600 is shown in FIG. 14A. Clamp 600 is used in the manner described above from clamp 100. Clamp 600 includes a base 602 and a cap 604 pivotally coupled to base 602. A hinge 606 allows clamp 600 to move between an open position shown in FIG. 13C and a closed position shown in FIGS. 13A and B. In this embodiment, hinge 606 comprises a barrel 610 and a pin 608. Barrel 610 is coupled to base 602 and pin 608 is coupled to cap 604. Pin 608 is snap-fit into barrel 610, allowing cap 604 to rotate around the pivot axis of pin 608. Base 602 and cap 604 also cooperate to define a snap-fit latch 612 including lever 614 formed on base 602 and a catch 616 (as shown in FIG. 14C) formed in cap 604. A head 618 is coupled at the top end of lever 614. Catch 616 is coupled to cap 604 at the opposite side of hinge 606 and configured to fit under head 618 of lever 614. During movement from the open to closed configurations, lever 614 flexes as head 618 ramps against catch 616 and snaps into position below lever 614 to hold cap 604 in position as shown in FIG. 14B. To release cap 604 from the closed position, a user pulls lever 614 in a direction away from catch 616, so lever 614 is no longer positioned over catch 616, allowing cap 604 to move to the open configuration. As shown in FIG. 14I, catch 616 and cap 604 define a catch hinge 613 coupled to cap 604. Catch hinge 613 can be a living hinge. Catch hinge 613 is located in indent 605, but the end of catch 616 opposite to catch hinge 613 is out of the indent (as shown in FIG. 14J).

Figure 14G:
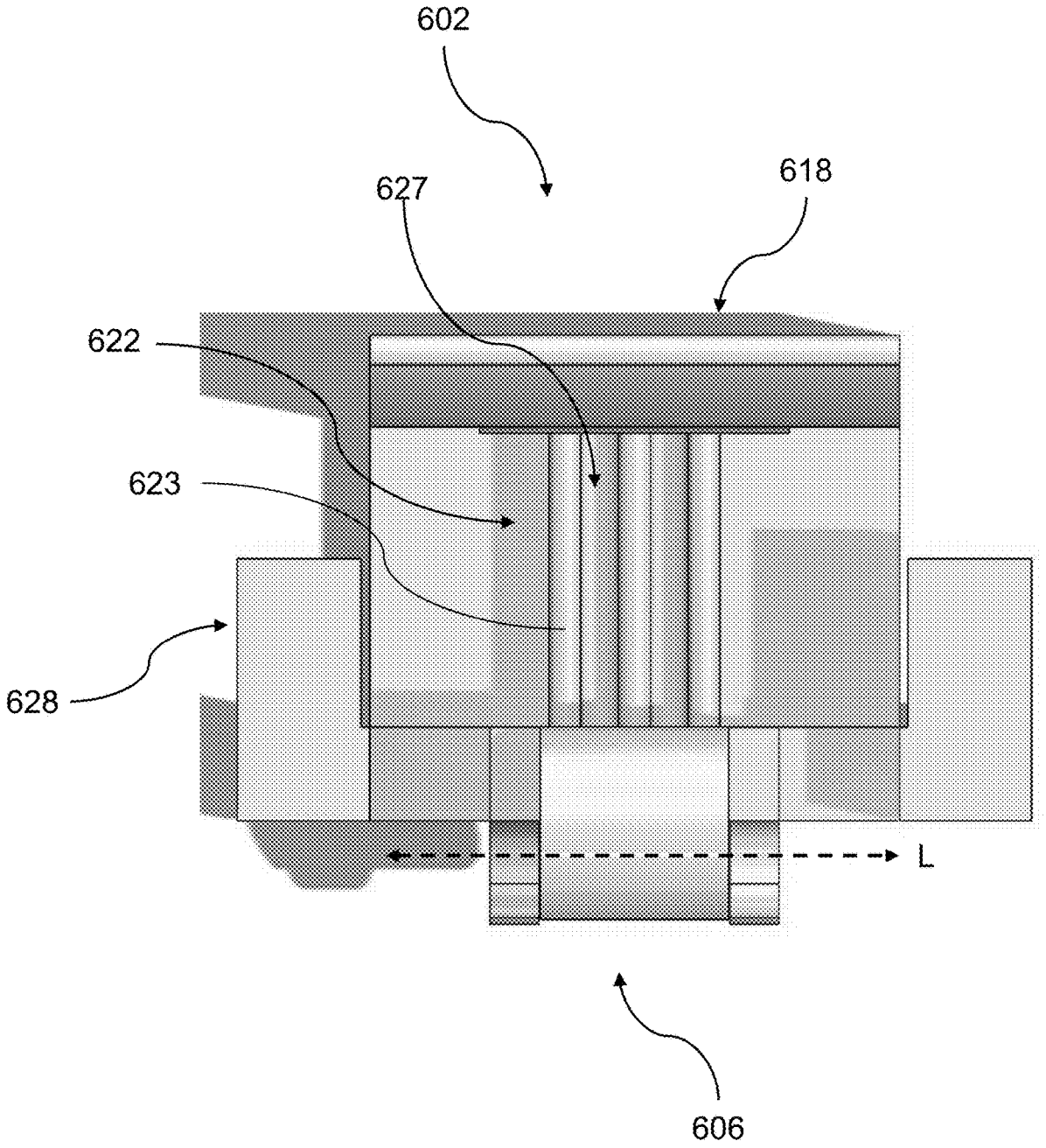
FIG. 14G is a top view of the base of the clamp in FIG. 14A without the cap.
Figure 14H:
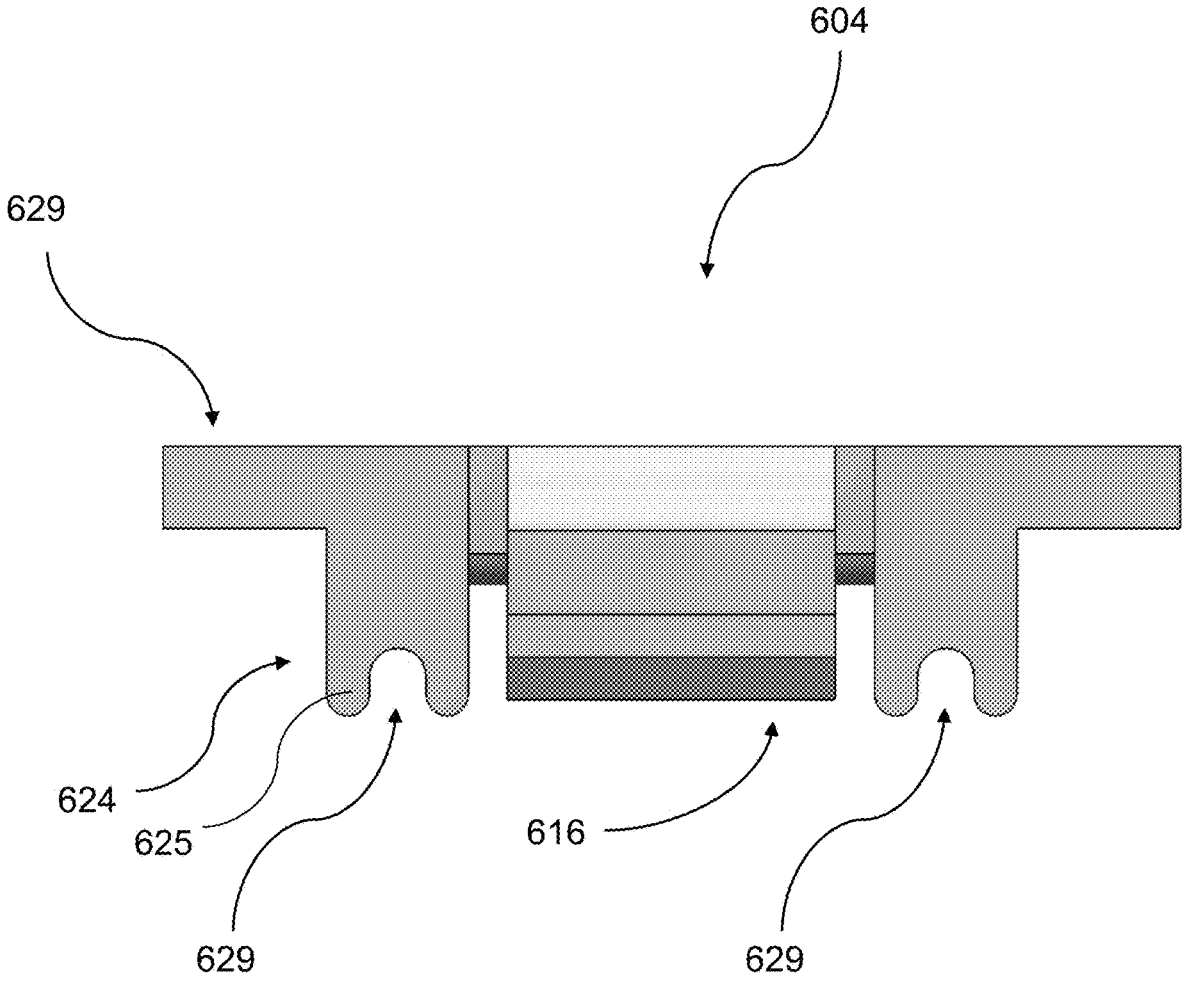
FIG. 14H is a front view of the cap of the clamp in FIG. 14A without the base.
Figure 14I:
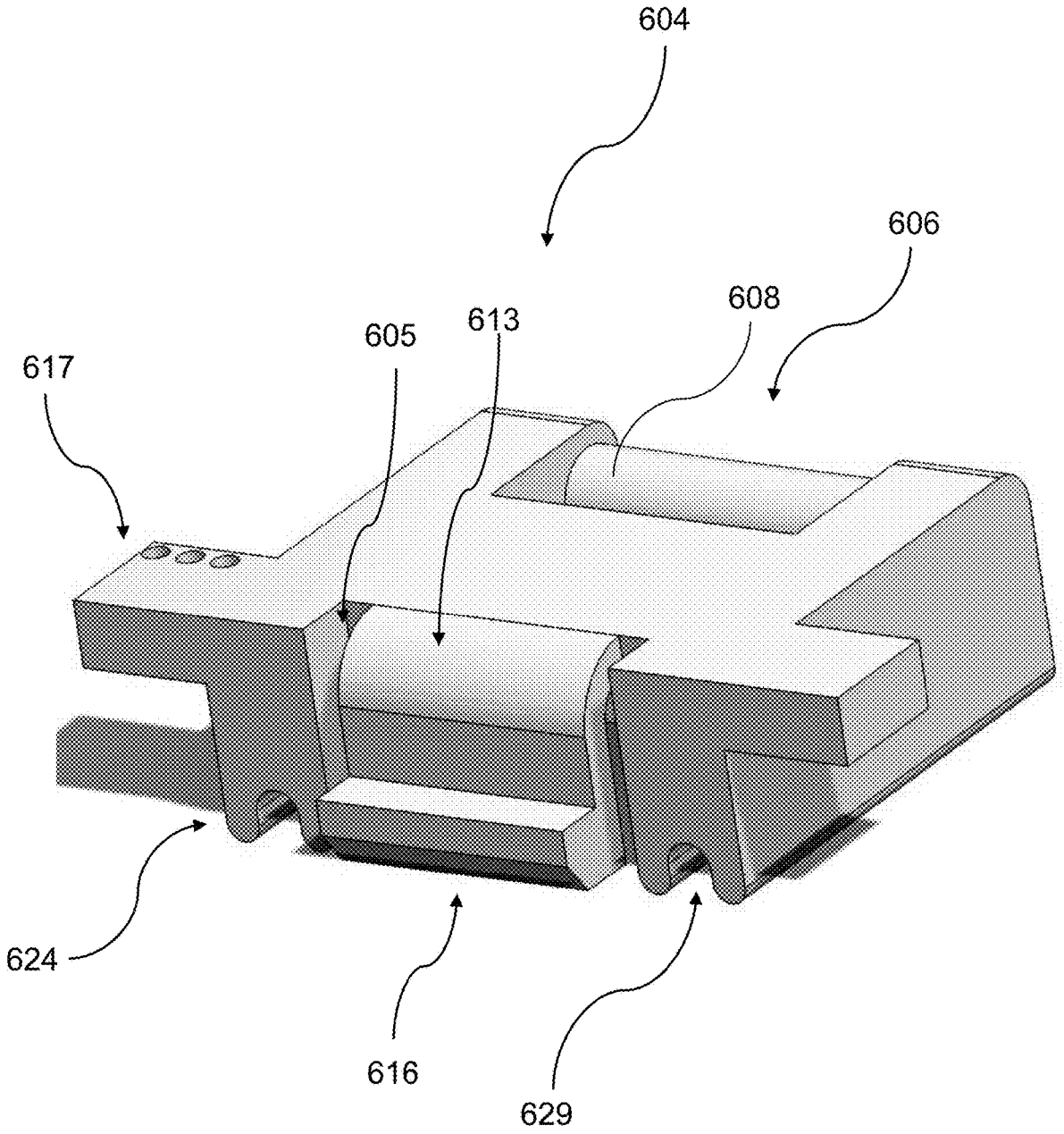
FIG. 14I is a perspective view of the cap of the clamp in FIG. 14A without the base.
Figure 14J:
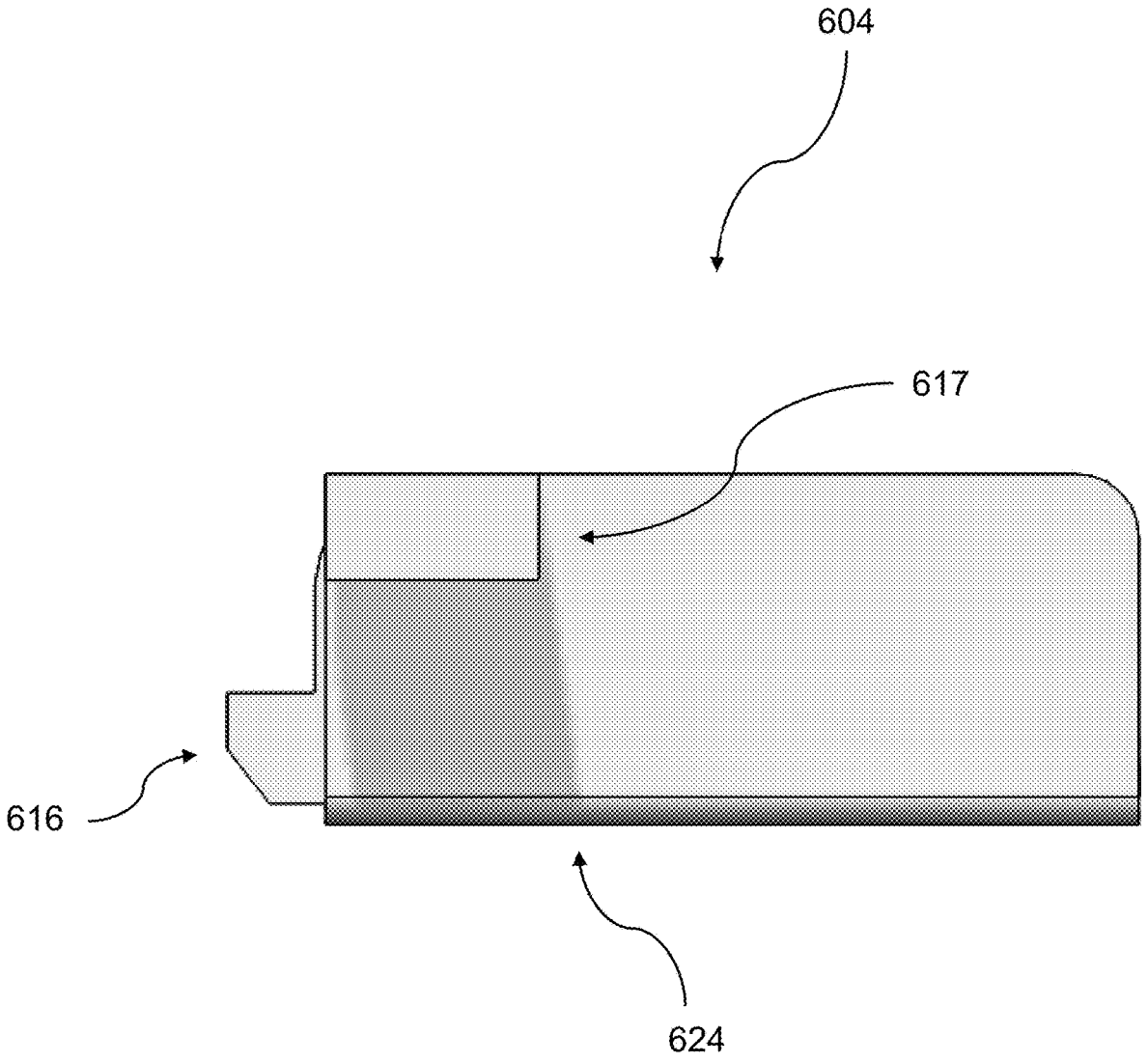
FIG. 14J is a side view of the cap of the clamp in FIG. 14A without the base.
Figure 14K:
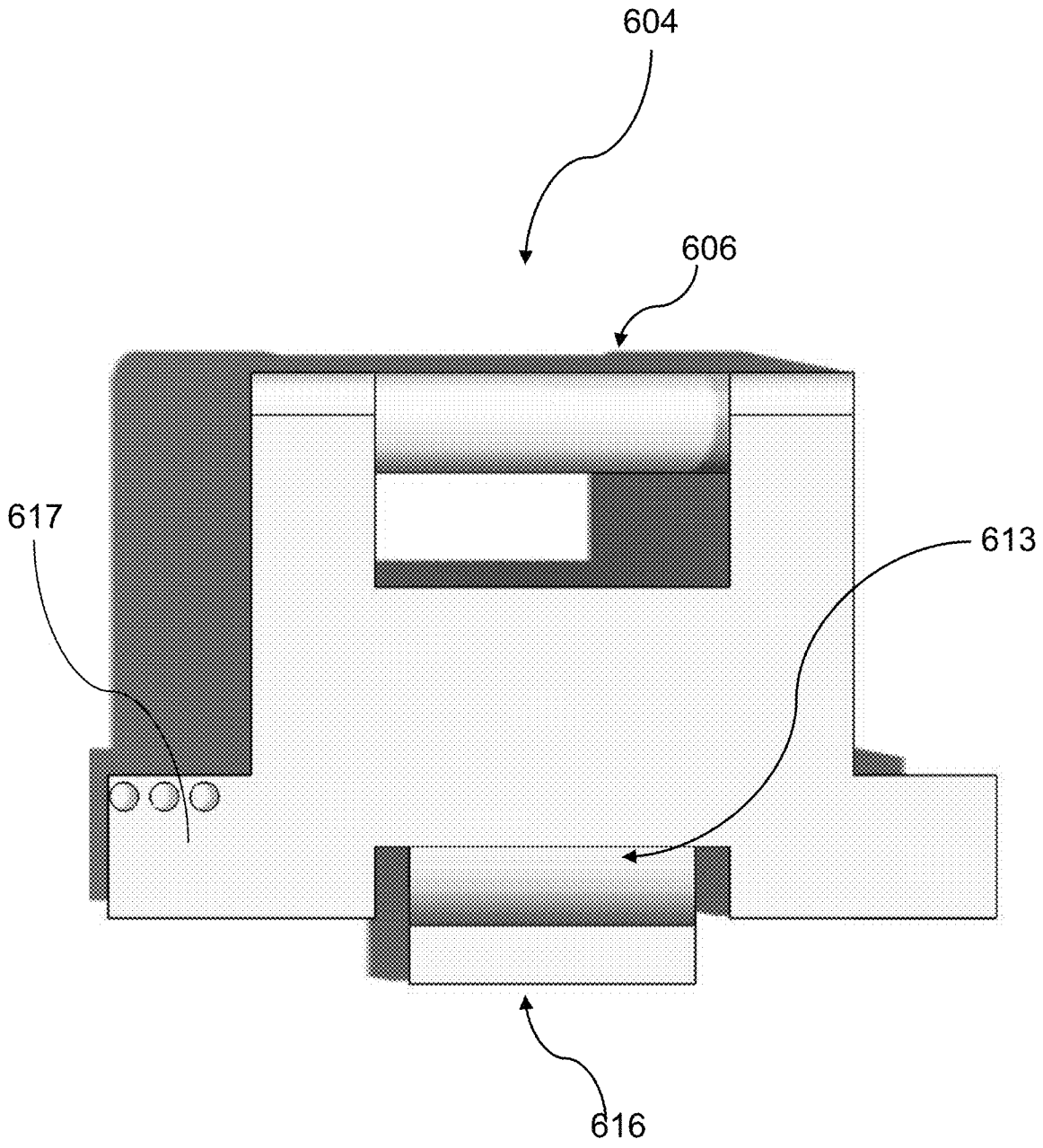
FIG. 14K is a top view of the cap of the clamp in FIG. 14A without the base.

As shown in FIGS. 14C-E and 14G-I, base 602 and cap 604 include staggered sets 622, 624 of teeth, which include a plurality of first protrusions 623 on base 602 and a plurality of second protrusions 625 on cap 604. First protrusions 623 defines at least one first slots 627 (as shown in FIG. 14G) elongating along an axis transverse to the longitudinal axis L (also the pivot axis) of hinge 606. Second protrusions 625 are at both side of the plurality of first protrusions 623 and define a plurality of second slots 629. Second slots 629 are substantially parallel to first slots 627. Base 602 further includes a pair of base arms 628 positioned on each side of sets 622, 624 of teeth. Cap 604 further includes a pair of cap arms 617 extending away from an indent 605 at an edge of cap 604 opposite to hinge 606, and the pair of cap arms 617 are transverse with the pair of base arms 628.

Figure 15A:
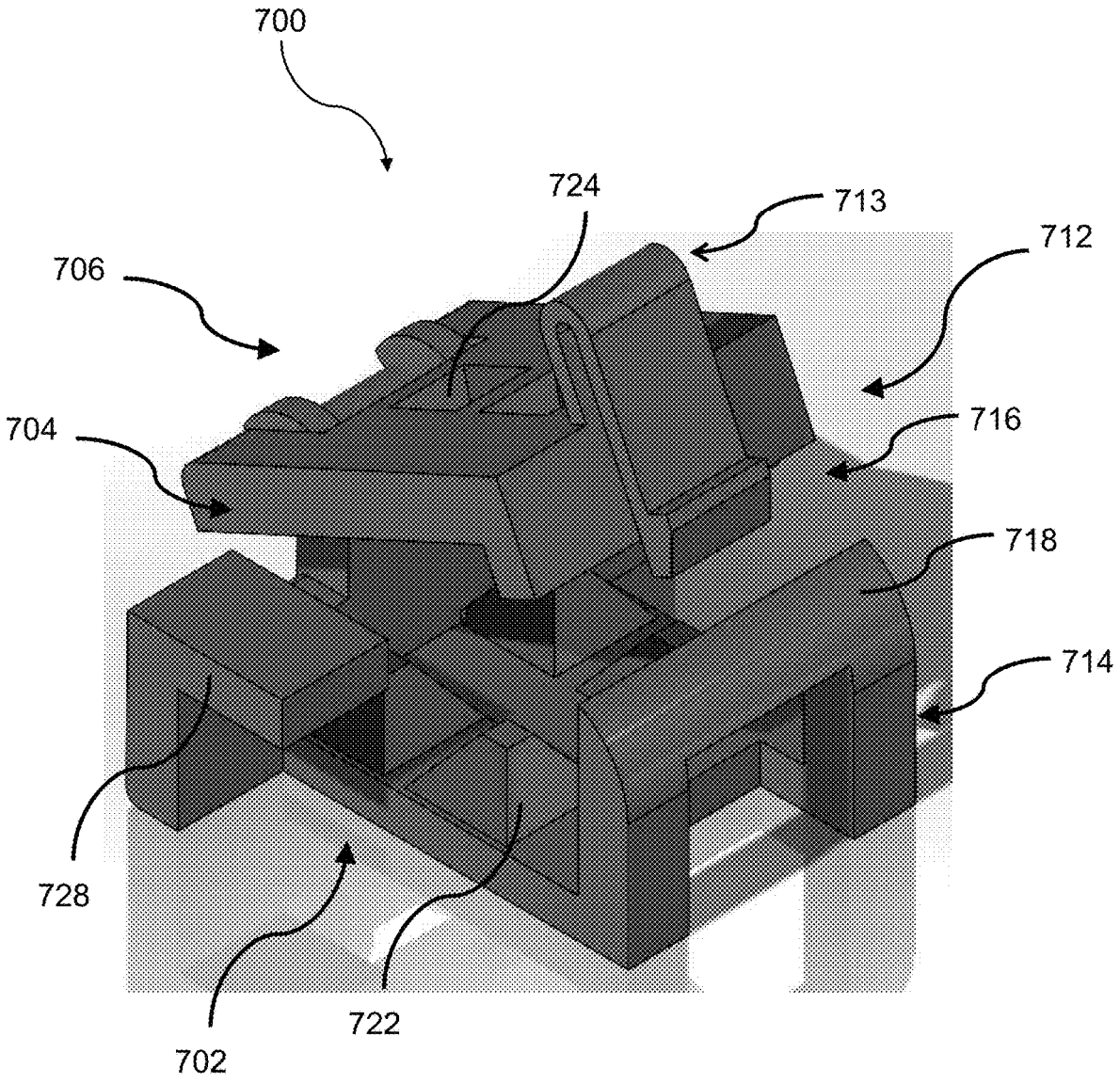
FIG. 15A is a perspective view of another embodiment lace clamp showing the clamp including a base and a cap coupled to the base in an open position.
Figure 15B:
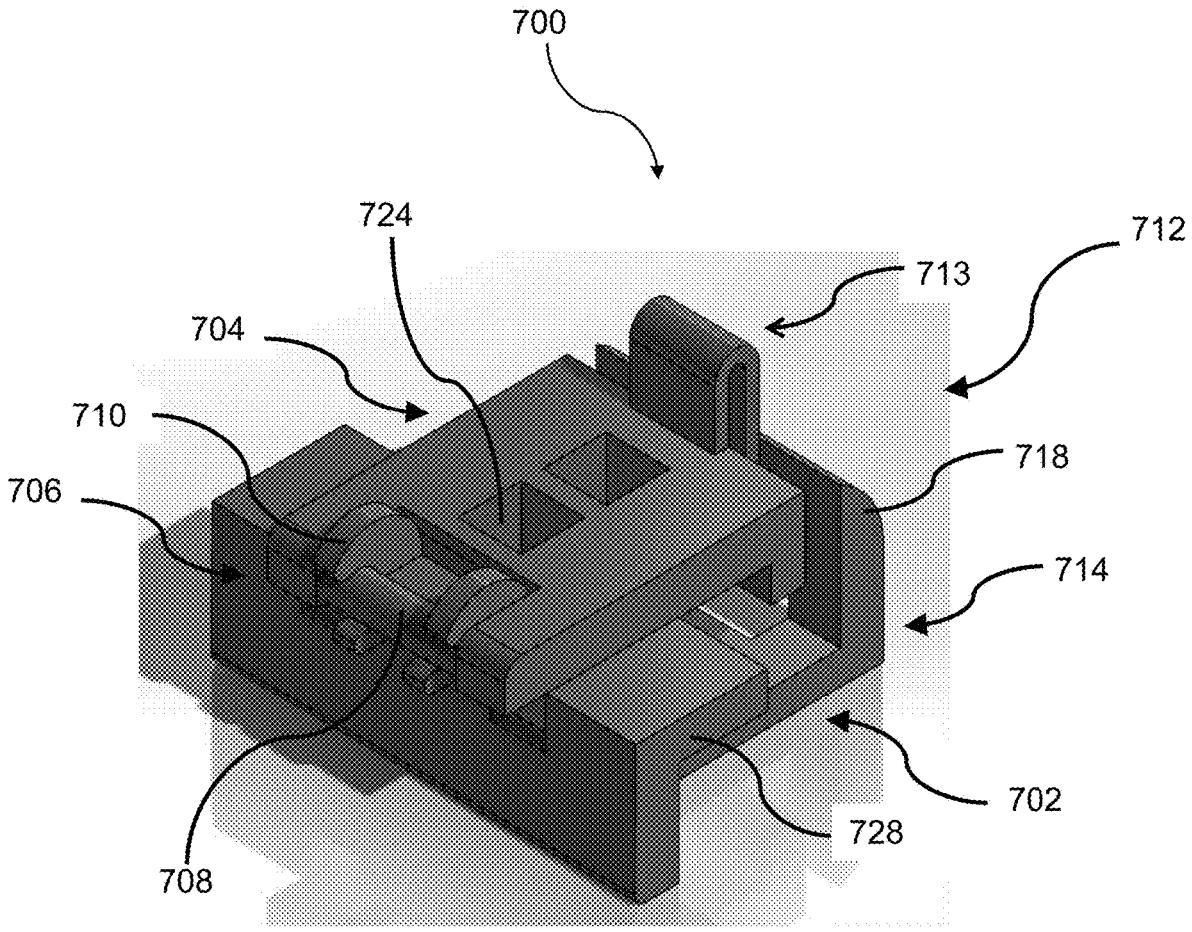
FIG. 15B is another perspective view of the clamp in FIG. 15A showing the clamp in a closed configuration.

An alternative embodiment clamp 700 is shown in FIG. 15A. Clamp 700 is used in the manner described above for clamp 100. Clamp 700 includes a base 702 and a cap 704 pivotally coupled to base 702. Base 702 and cap 704 cooperate to define a hinge 706. Hinge 706 includes a pin 708 and a barrel 710. Barrel 710 receive pin 708. Barrel 710 may have two sub-barrels spaced apart at two ends of pin 708. Hinge 706 allows clamp 700 to move between an open position in FIG. 15A and a closed position in FIG. 15B. Base 702 and cap 704 also cooperate to define a snap-fit latch 712 including lever 714 formed on base 702 and a catch 716 formed on cap 704. During movement from the open to closed configurations, lever 714 flexes as a head 718 of lever 714 ramps against catch 716 and snaps into position above catch 716 to hold cap 704 in position as shown in FIG. 15B. To release cap 704 from the closed position, a user pulls lever 714 in a direction away from catch 716 so head 718 is no longer positioned over catch 716 allowing cap 704 to move to an open position.

Base 702 and cap 704 include staggered sets 722, 724 of teeth. Staggered sets 722, 724 can be substantially pyramid-shaped. Staggered sets 722,724 can have substantially flat tops. Staggered sets 722, 724 can be hollowed as shown in FIG. 15A. Staggered sets 722 may include four pyramid-shaped protrusions on base 702, and staggered sets 524 may include two pyramid-shaped protrusions on cap 504. Two pyramid-shaped protrusions on cap 502 are placed between four pyramid-shaped protrusions on base 502 when clamp 700 is the closed position. Base 702 further includes a pair of arms 728 positioned on each side of set 722 of teeth. As shown in 15A, catch 716 and cap 704 define a catch hinge 713. Catch hinge 713 can be a living hinge, and the top of catch hinge 713 is higher than the top surface of cap 704.

The designs described above can be used interchangeably between different embodiments. For example, latch 512 of clamp 500 can be changed to the design of latches 112, 212, 312, 412, 612, 712 in clamp 100, 200, 300, 400, 600, 700. The hinge designs and the staggered set designs can also be used interchangeably. The clamps described about can be used on footwear including, but not limited to, shoes, skates, or hockey shoes.

I claim:

1. A footwear comprising:

a sole, an upper supported by the sole, the upper having a plurality of attachments including first and second attachments, and at least one lace coupled to the upper, the at least one lace having a plurality of lace portions including a first upper-most attachment lace portion extending down from the first attachment and a second upper-most attachment lace portion extending down from the second attachment, and a clamp positioned below the first and second attachments and coupling two of the plurality of lace portions together, the clamp comprising:

a cap, a base, a hinge pivotally coupling the cap and base together, a plurality of protrusions supported by at least one of the cap and base, the plurality of protrusions being pyramid-shaped and having substantially flat top surfaces, and at least one of the plurality of the protrusions being positioned between at least two of the plurality of protrusions, and a latch configured to secure the cap to the base.

2. The footwear of claim 1, wherein the plurality of protrusions are staggered.

3. The footwear of claim 1, wherein the latch comprises a lever and a catch configured to form a snap.

4. The footwear of claim 3, wherein the lever includes a head positioned at a distal end of the lever and the catch is configured to substantially enclose the head.

5. The footwear of claim 1, wherein the base has a barrel, the cap has a pin, and the pin is positioned in the barrel to define the hinge.

6. The footwear of claim 5, wherein the barrel has an opening configured to receive the pin and faces away from the latch.

7. The footwear of claim 5, wherein the barrel has an upper barrel arm and two lower barrel arms and the upper barrel arms and the two lower barrel arms clamp the pin from two opposite sides.

8. The footwear of claim 1, wherein the plurality of protrusions includes a plurality of first staggered protrusions positioned on at least one of the cap and the base, the at least one second staggered protrusion is positioned between the plurality of the first staggered protrusions, and the plurality of the first staggered protrusions and the plurality of the second staggered protrusion extend transversely to a pivot axis about the hinge.

9. The footwear of claim 1, wherein the hinge comprises a hook coupled to the base and a bar coupled to the cap and the bar is snap-fit to the hook.

* * * * *